US009797024B2

(12) United States Patent
Yokoi et al.

(10) Patent No.: US 9,797,024 B2
(45) **Date of Patent: *Oct. 24, 2017**

(54) HOT-ROLLED STEEL SHEET FOR GAS NITROCARBURIZING AND MANUFACTURING METHOD THEREOF

(71) Applicant: Nippon Steel & Sumitomo Metal Corporation, Tokyo (JP)

(72) Inventors: Tatsuo Yokoi, Tokyo (JP); Hiroshi Shuto, Tokyo (JP); Riki Okamoto, Tokyo (JP); Nobuhiro Fujita, Tokyo (JP); Kazuaki Nakano, Tokyo (JP); Takeshi Yamamoto, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/239,497

(22) Filed: Aug. 17, 2016

(65) Prior Publication Data

US 2016/0355899 A1 Dec. 8, 2016

Related U.S. Application Data

(62) Division of application No. 14/110,551, filed as application No. PCT/JP2012/060151 on Apr. 13, 2012, now Pat. No. 9,453,269.

(30) Foreign Application Priority Data

Apr. 13, 2011 (JP) ..... 2011-089491

(51) Int. Cl.
*C21D 9/46* (2006.01)
*C22C 38/00* (2006.01)
(Continued)

(52) U.S. Cl.
CPC ..... *C21D 9/46* (2013.01); *C21D 8/0226* (2013.01); *C21D 8/0263* (2013.01);
(Continued)

(58) Field of Classification Search
CPC ..... C22C 38/14; C22C 38/06; C22C 38/02
See application file for complete search history.

(56) References Cited

U.S. PATENT DOCUMENTS 4,769,088 A 9/1988 Itami et al.
6,290,784 B1 * 9/2001 Yasuhara et al. ..... 148/320
(Continued)

FOREIGN PATENT DOCUMENTS

CN 1599802 3/2005
CN 1989267 6/2007
(Continued)

OTHER PUBLICATIONS

Chinese Office Action in Application No. 201280017163.X, dated Dec. 18, 2014, with English language translation.
(Continued)

*Primary Examiner* — Rebecca Lee
(74) *Attorney, Agent, or Firm* — Birch, Stewart, Kolasch & Birch, LLP

(57) ABSTRACT

In a hot-rolled steel sheet, an average pole density of an orientation group of {100}<011> to {223}<110>, which is represented by an arithmetic average of pole density of each orientation of {100}<011>, {116}<110>, {114}<110>, {112}<110>, and {223}<110> in a center portion of a sheet thickness which is a range of the sheet thickness of ⅝ to ⅜ from a surface of the steel sheet, is 1.0 or more and 4.0 or less, the pole density of a crystal orientation of {332}<113> is 1.0 or more and 4.8 or less, an average grain size in a center in the sheet thickness is 10 μm or less, and a
(Continued)

microstructure includes, by a structural fraction, pearlite more than 6% and ferrite in the balance.

6 Claims, 2 Drawing Sheets

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/14*** | (2006.01) |
| ***C21D 8/02*** | (2006.01) |
| ***C22C 38/08*** | (2006.01) |
| ***C22C 38/12*** | (2006.01) |
| ***C22C 38/16*** | (2006.01) |
| ***C22C 38/22*** | (2006.01) |
| ***C22C 38/24*** | (2006.01) |
| ***C22C 38/26*** | (2006.01) |
| ***C22C 38/32*** | (2006.01) |
| ***C22C 38/34*** | (2006.01) |
| ***C22C 38/38*** | (2006.01) |
| ***C22C 38/36*** | (2006.01) |
| ***C22C 38/10*** | (2006.01) |
| ***C22C 38/28*** | (2006.01) |

(52) U.S. Cl.

CPC ..... *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/105* (2013.01); *C22C 38/12* (2013.01); *C22C 38/14* (2013.01); *C22C 38/16* (2013.01); *C22C 38/22* (2013.01); *C22C 38/24* (2013.01); *C22C 38/26* (2013.01); *C22C 38/28* (2013.01); *C22C 38/32* (2013.01); *C22C 38/34* (2013.01); *C22C 38/36* (2013.01); *C22C 38/38* (2013.01); *C21D 2211/005* (2013.01); *C21D 2211/009* (2013.01)

(56) References Cited

U.S. PATENT DOCUMENTS

| | | | |
|---|---|---|---|
| 2001/0004910 | A1 | 6/2001 | Yasuhara et al. |
| 2004/0069382 | A1 | 4/2004 | Yokoi et al. |
| 2009/0223609 | A1 | 9/2009 | Hakomori et al. |

FOREIGN PATENT DOCUMENTS

| | | | | |
|---|---|---|---|---|
| CN | 101535519 | | | 9/2009 |
| CN | 101748347 | | | 6/2010 |
| EP | 2116624 | | | 11/2009 |
| JP | 06-293910 | | | 10/1994 |
| JP | 09-049065 | | | 2/1997 |
| JP | 10-183255 | | | 7/1998 |
| JP | 2000-297350 | A | | 10/2000 |
| JP | 2002-322540 | | | 11/2002 |
| JP | 2002-322541 | | | 11/2002 |
| JP | 2004-002934 | | | 1/2004 |
| JP | 2004-131754 | | | 4/2004 |
| JP | 2006-124789 | | | 5/2006 |
| JP | 2006-193819 | | | 7/2006 |
| JP | 2006193819 | A | * | 7/2006 |
| JP | 2008-189978 | | | 8/2008 |
| JP | 2008-274355 | A | | 11/2008 |
| JP | 2009-068057 | | | 4/2009 |
| JP | 2009-132988 | A | | 6/2009 |
| JP | 2009-263715 | | | 11/2009 |
| JP | 2009-263718 | A | | 11/2009 |
| JP | 2011-012308 | | | 1/2011 |
| JP | 2011-017044 | | | 1/2011 |
| JP | 2011-026690 | | | 2/2011 |
| JP | 2012-062561 | A | | 3/2012 |
| TW | 2005-17507 | | | 6/2005 |
| WO | WO 2010/131761 | | | 11/2010 |
| WO | WO 2012/014296 | | | 2/2012 |

OTHER PUBLICATIONS

Extended European Search Report issued in Application No. 12771020.0, dated Feb. 5, 2015.

Final Office Action for U.S. Appl. No. 14/110,551 dated Feb. 3, 2016.

International Search Report for PCT application No. PCT/JP2012/060132, dated Jul. 17, 2012, with English language translation.

International Search Report for PCT application No. PCT/JP2012/060151, dated Jul. 17, 2012, with English language translation.

Non-Final Office Action for U.S. Appl. No. 14/110,551 dated Sep. 18, 2015.

Notice of Allowance for U.S. Appl. No. 14/110,551 dated May 18, 2016.

Notice of Allowance issued in Korean Application No. 10-2013-7027021, dated Jun. 22, 2015, with English language translation.

Notice of Allowance issued in Korean Application No. 10-2013-7027173 dated Jun. 22, 2015, with English language translation.

Office Action for U.S. Appl. No. 14/110,551 dated Jun. 29, 2015.

Search Report in European Application No. 12771475.6, dated Jan. 27, 2015, with English language translation.

Taiwanese Office Action for Application No. 101113229, dated Dec. 10, 2013, with English language translation.

Taiwanese Office Action for Application No. 101113231, dated Feb. 19, 2014, with English language translation.

Non Final Office Action, dated Sep. 21, 2016, for U.S. Appl. No. 14/008,205.

U.S. Notice of Allowance for U.S. Appl. No. 14/008,205 dated Apr. 20, 2017.

* cited by examiner

HOT-ROLLED STEEL SHEET FOR GAS NITROCARBURIZING AND MANUFACTURING METHOD THEREOF

CROSS REFERENCE TO RELATED APPLICATIONS

This application is a Divisional of copending application Ser. No. 14/110,551, filed on Oct. 8, 2013, which was filed as PCT International Application No. PCT/JP2012/060151 on Apr. 13, 2012, which claims the benefit under 35 U.S.C. §119(a) to Patent Application No. 2011-089491, filed in Japan on Apr. 13, 2011, all of which are hereby expressly incorporated by reference into the present application.

TECHNICAL FIELD

The present invention relates to a hot-rolled steel sheet for gas nitrocarburizing having improved isotropic workability and a manufacturing method thereof.

BACKGROUND ART

Recently, in order to achieve a weight saving of various members for improving fuel consumption of an automobile, thinning by high-strengthening of a steel sheet such as an iron alloy or application of a light metal such as Al alloy has been developed. Compared to a heavy metal such as steel, the light metal such as Al alloy has an advantage such as having high specific strength, but there is a disadvantage such as having significantly high costs. Thereby, the application of the light metal is limited to a specific use. Accordingly, in order to promote weight reduction of various members at lower cost and in a wider range, the thinning by high-strengthening of the steel sheet is needed.

In general, due to the high-strengthening of the steel sheet, deterioration of material characteristics such as formability (workability) is accompanied. Thereby, improvement of the high-strengthening without deterioration of the material characteristics is important in the development of a high-strength steel sheet. Particularly, a steel sheet, which is used as a vehicle member such as an inner sheet member, a structural member, a suspension member, or a transmission, requires bendability, stretch-flange workability, burring workability, ductility, fatigue durability, impact resistance (toughness), corrosion resistance, or the like according to the use. Accordingly, having an improved balance of material characteristics at a high level and high standard is important.

Particularly, in automobile parts, a part in which a sheet metal is processed as a material and functions as a rotating body, for example, a drum, a carrier, or the like configuring an automatic transmission is an important part which transmits engine output to an axle shaft. The part requires circularity or uniformity of a sheet thickness in a circumferential direction as a shape for decreasing friction or the like. In addition, since a forming type such as burring processing, drawing, ironing, or stretch forming is used when the part is formed, ultimate deformability which is represented by local elongation is significantly important.

Moreover, it is preferable to improve impact resistance, that is, toughness in the steel sheet used for the member, in which the impact resistance is a characteristic in which the member is not easily broken even though the member receives impact due to collision or the like after the formed member is mounted to an automobile as a part of the automobile. Particularly, when use of the member under a cold climate is considered, it is preferable to improve the toughness at low temperature (low-temperature toughness) in order to secure the impact resistance at low temperature. Thereby, it is important to increase the impact resistance of the steel. In addition, the impact resistance (toughness) is defined by vTrs (Charpy fracture appearance transition temperature) or the like.

That is, in a steel sheet for a part including the above-described part which requires uniformity of a sheet thickness, satisfying both of plastic isotropy and impact resistance (toughness) is required in addition to improved workability.

For example, in Patent Document 1, in order to satisfy both of high strength and various material characteristics which particularly contribute to fox inability, a manufacturing method of the steel sheet, which satisfies high strength, ductility, and hole expansibility by including a steel structure which has ferrite of 90% or more and the balance consisting of bainite, is disclosed.

However, in the steel sheet which is manufactured by applying the technique disclosed in Patent Document 1, the plastic isotropy is not disclosed at all. Thereby, for example, if it is assumed that the steel sheet of Patent Document 1 is applied to a part such as a gear which requires circularity or uniformity of the sheet thickness in the circumferential direction, unfair vibration due to eccentricity of the part or a decrease in the output due to friction loss is concerned.

Moreover, for example, in Patent Documents 2 and 3, a hot-rolled high tensile steel sheet, which has high strength and improved stretch flangeability by adding Mo and refining precipitates, is disclosed.

However, in the steel sheet to which the above-described technique disclosed in Patent Documents 2 and 3 is applied, since it is essential to add Mo, which is an expensive alloy element, by 0.07% or more, there is a problem that the manufacturing costs are increased. Moreover, in the technique disclosed in Patent Documents 2 and 3, the plastic isotropy is not disclosed at all. Thereby, if it is assumed that the steel sheet of Patent Documents 2 and 3 is applied to a part which requires circularity or uniformity of the sheet thickness in the circumferential direction, unfair vibration due to eccentricity of the part or a decrease in the output due to friction loss is concerned.

On the other hand, for example, in Patent Document 4, with respect to improvement in plastic isotropy of the steel sheet, that is, a decrease of the plastic anisotropy, a technique is disclosed which makes texture at austenite of a surface shear layer be adequate by combining endless rolling and lubricant rolling and decreases in-plane anisotropy of a r value (Lankford value).

However, the endless rolling is needed for preventing defective biting caused by slip between a roll caliber tool and a rolled material during rolling in order to perform the lubricant rolling having a small friction coefficient over the full length of a coil. Thereby, since equipment investment such as a rough bar joining device or a high-speed crop shear is accompanied to apply the technique of Patent Document 4, a burden is large.

In addition, for example, in Patent Document 5, a technique is disclosed which satisfies both of stretch flangeability and deep drawability by decreasing anisotropy of a r value in a steel sheet having strength level of 780 MPa or more which is obtained by compositely adding Zr, Ti, and Mo and ending finish rolling at high temperature of 950° C. or more.

However, since adding Mo, which is an expensive alloy element, of 0.1% or more is essential, there is a problem that the manufacturing costs are increased.

Research for improving toughness of a steel sheet has been advanced than conventional. However, a hot-rolled steel sheet for gas nitrocarburizing having high strength, improved plastic isotropy and toughness is not disclosed in the above-described Patent Documents 1 to 5.

PRIOR ART DOCUMENT

Patent Document

[Patent Document 1] Japanese Unexamined Patent Application, First Publication No. H6-293910

[Patent Document 2] Japanese Unexamined Patent Application, First Publication No. 2002-322540

[Patent Document 3] Japanese Unexamined Patent Application, First Publication No. 2002-322541

[Patent Document 4] Japanese Unexamined Patent Application, First Publication No. H10-183255

[Patent Document 5] Japanese Unexamined Patent Application, First Publication No. 2006-124789

DISCLOSURE OF THE INVENTION

Problem to be Solved by the Invention

The present invention is made in consideration of the above-described problems. That is, an object of the present invention is to provide a hot-rolled steel sheet for gas nitrocarburizing which has a high strength of 440 MPa or more in tensile strength, can be applied to a member which requires ductility and strict uniformity of a sheet thickness, circularity, and impact resistance after processing, has improved isotropic workability (isotropy) and hole expansibility, and exhibits sufficient chipping resistance and rolling fatigue resistance after gas nitrocarburizing treatment, and a manufacturing method which can inexpensively and stably manufacture the steel sheet.

Means for Solving the Problems

In order to solve the above-described problems and achieve the related object, the present invention adopts the following measures.

(1) According to an aspect of the present invention, there is provided a hot-rolled steel sheet, by mass %, C content [C]: C of more than 0.07% and equal to or less than 0.2%, Si content [Si]: Si of 0.001% or more and 2.5% or less, Mn content [Mn]: Mn of 0.01% or more and 4% or less, and Al content [Al]: Al of 0.001% or more and 2% or less, P content [P] limited to 0.15% or less, S content [S] limited to 0.03% or less, and N content [N] limited to 0.01% or less, Ti content [Ti] which satisfies the following Equation (a), the balance consisting of Fe and unavoidable impurities, in which an average pole density of an orientation group of {100}<011> to {223}<110>, which is represented by an arithmetic average of pole density of each orientation of {100}<011>, {116}<110>, {114}<110>, {112}<110>, and {223}<110> is 1.0 or more and 4.0 or less, a pole density of a crystal orientation of {332}<113> is 1.0 or more and 4.8 or less, in a center portion of a sheet thickness which is a range of the sheet thickness of ⅝ to ⅜ from a surface of the steel sheet, and in which an average grain size in a center in the sheet thickness is 10 μm or less; and a microstructure includes, by a structural fraction, pearlite of more than 6% and ferrite in the balance.

$$0.005+[N]\times 48/14+[S]\times 48/32 \leq Ti \leq 0.015+[N]\times 48/14+[S]\times 48/32 \quad (a)$$

(2) In the hot-rolled steel sheet for gas nitrocarburizing according to (1), the average pole density of the orientation group of {100}<01.1> to {223}<110> may be 2.0 or less and the pole density of the crystal orientation of {332}<113> may be 3.0 or less.

(3) In the hot-rolled steel sheet for gas nitrocarburizing according to (1), the average grain size may be 7 μm or less.

(4) The hot-rolled steel sheet for gas nitrocarburizing according to any one of (1) to (3), may further include any one or two or more of, by mass %, Nb content [Nb]: Nb of 0.005% or more and 0.06% or less, Cu content [Cu]: Cu of 0.02% or more and 1.2% or less, Ni content [Ni]: Ni of 0.01% or more and 0.6% or less, Mo content [Mo]: Mo of 0.01% or more and 1% or less, V content [V]: V of 0.01% or more and 0.2% or less, Cr content [Cr]: Cr of 0.01% or more and 2% or less, Mg content [Mg]: Mg of 0.0005% or more and 0.01% or less, Ca content [Ca]: Ca of 0.0005% or more and 0.01% or less, REM content [REM]: REM of 0.0005% or more and 0.1% or less, and B content [B]: B of 0.0002% or more and 0.002% or less.

(5) According to another aspect of the present invention, there is provided a manufacturing method of a hot-rolled steel sheet for gas nitrocarburizing, including: performing a first hot rolling, which includes one of more of rolling reduction having a rolling-reduction ratio of 40% or more at a temperature range of 1000° C. or more and 1200° C. or less, with respect to a steel ingot or a slab which includes, by mass %, C content [C]: C of more than 0.07% and equal to or less than 0.2%, Si content [Si]: Si of 0.001% or more and 2.5% or less, Mn content [Mn]: Mn of 0.01% or more and 4% or less, and Al content [Al]: Al of 0.001% or more and 2% or less, and P content [P] limited to 0.15% or less, S content [S] limited to 0.03% or less, and N content [N] limited to 0.01% or less, Ti content [Ti] contains Ti which satisfies the following Equation (a), and the balance consists of Fe and unavoidable impurities; starting a second hot rolling at a temperature range of 1000° C. or more within 150 seconds after a completion of the first hot rolling, performing rolling includes one or more of rolling reduction having a rolling-reduction ratio of 30% or more in a temperature range of T1+30° C. or more and T1+200° C. or less when temperature determined by a component of the steel sheet in the following Equation (h) is defined as T1° C. in the second hot rolling and a total of the rolling-reduction ratio is 50% or more; performing a third hot rolling, in which a total of the rolling-reduction ratio is 30% or less, at a temperature range equal to or more than an Ar3 transformation point temperature and less than T1+30° C.; ending the hot rollings at the Ar3 transformation point temperature or more; when a pass having rolling-reduction ratio of 30% or more at the temperature range of T1+30° C. or more and T1+200° C. or less is a large rolling-reduction pass, performing a cooling, in which a cooling temperature change is 40° C. or more and 140° C. or less and a cooling end temperature is T1+100° C. or less, at a cooling rate of 50° C./second or more so that a waiting time t second from a completion of a final pass of the large rolling-reduction passes to a start of cooling satisfies the following Equation (c); and coiling the steel sheet at more than 550° C.

$$0.005+[N]\times 48/14+[S]\times 48/32 \leq Ti \leq 0.015+[N]\times 48/14+[S]\times 48/32 \quad (a)$$

$$T1=850+10\times([C]+[N])\times[Mn]+350\times[Nb]+250\times[Ti]+40\times[B]+10\times[Cr]+100\times[Mo]+100\times[V] \quad (b)$$

$$t \leq 2.5\times t1 \quad (c)$$

Here, t1 is represented by the following Equation (d).

$$t1=0.001\times((Tf-T1)\times P1/100)^2-0.109\times((Tf-T1)\times P1/100)+3.1 \quad (d)$$

Here, Tf is a temperature (° C.) after the final pass rolling reduction of the large rolling-reduction passes and P1 is a rolling-reduction ratio (%) of the final pass of the large rolling-reduction passes.

(6) In the manufacturing method of a hot-rolled steel sheet for gas nitrocarburizing according to (5), the primary cooling may perform cooling between rolling stands.

(7) In the manufacturing method of a hot-rolled steel sheet for gas nitrocarburizing according to (5) or (6), the waiting time t second may further satisfy the following Equation (e).

$$t1 \leq t \leq 2.5 \times t1 \quad \text{(e)}$$

(8) In the manufacturing method of a hot-rolled steel sheet for gas nitrocarburizing according to (5) or (6), the waiting time t second may further satisfy the following Equation (f).

$$t \leq t1 \quad \text{(f)}$$

(9) In the manufacturing method of a hot-rolled steel sheet for gas nitrocarburizing according to any one of (5) to (8), a temperature increase between the respective passes in the second hot rolling may be 18° C. or less.

(10) In the manufacturing method of a hot-rolled steel sheet for gas nitrocarburizing according to (9), the slab or the steel ingot may further include any one or two or more of, by mass %, Nb content [Nb]: Nb of 0.005% or more and 0.06% or less, Cu content [Cu]: Cu of 0.02% or more and 1.2% or less, Ni content [Ni]: Ni of 0.01% or more and 0.6% or less, Mo content [Mo]: Mo of 0.01% or more and 1% or less, V content [V]: V of 0.01% or more and 0.2% or less, Cr content [Cr]: Cr of 0.01% or more and 2% or less, Mg content [Mg]: Mg of 0.0005% or more and 0.01% or less, Ca content [Ca]: Ca of 0.0005% or more and 0.01% or less, REM content [REM]: REM of 0.0005% or more and 0.1% or less, and B content [B]: B of 0.0002% or more and 0.002% or less.

(11) In the manufacturing method of a hot-rolled steel sheet for gas nitrocarburizing according to any one of (5) to (8), the slab or the steel ingot may further include any one kind or two or more kinds of, by mass %, Nb content [Nb]: Nb of 0.005% or more and 0.06% or less, Cu content [Cu]: Cu of 0.02% or more and 1.2% or less, Ni content [Ni]: Ni of 0.01% or more and 0.6% or less, Mo content [Mo]: Mo of 0.01% or more and 1% or less, V content [V]: V of 0.01% or more and 0.2% or less, Cr content [Cr]: Cr of 0.01% or more and 2% or less, Mg content [Mg]: Mg of 0.0005% or more and 0.01% or less, Ca content [Ca]: Ca of 0.0005% or more and 0.01% or less, REM content [REM]: REM of 0.0005% or more and 0.1% or less, and B content [B]: B of 0.0002% or more and 0.002% or less.

Advantage of the Invention

According to the present invention, a high strength hot-rolled steel sheet for gas nitrocarburizing which can be applied to a member which requires ductility and strict uniformity of a sheet thickness, circularity, and impact resistance after processing and has improved isotropic workability, hole expansibility, and toughness, is obtained. In addition, the above-described hot-rolled steel sheet for gas nitrocarburizing can be inexpensively and stably manufactured. Therefore, the present invention has a high industrial value.

BEST MODE FOR CARRYING OUT THE INVENTION

Figure 1:
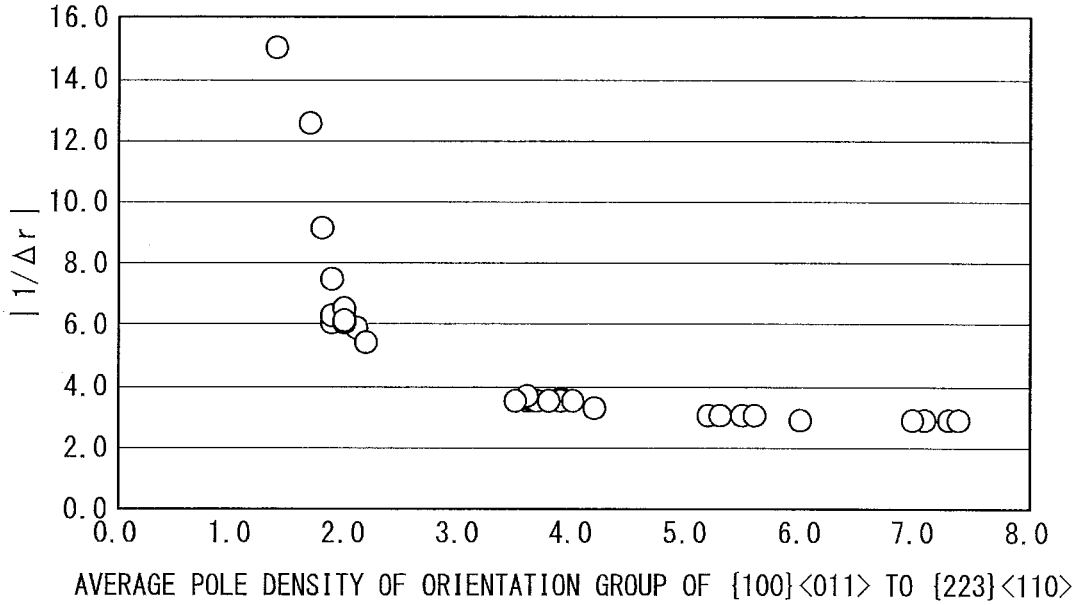
FIG. 1 is a view showing a relationship between average pole density of an orientation group of {100}<011> to {223}<110> and isotropy.

Hereinafter, an embodiment of the present invention will be described in detail. Moreover, hereinafter, mass % in a composition is simply described as %. Moreover, in the present embodiment, a hot-rolled steel sheet for gas nitrocarburizing having improved isotropic workability may be simply referred to as a hot-rolled steel sheet.

The inventors have diligently repeated research to satisfy both of isotropy and impact resistance in addition to workability with respect to a hot-rolled steel sheet for gas nitrocarburizing which is suitably applied to a member which requires ductility and strict uniformity of a sheet thickness, circularity, and impact resistance after processing.

In addition, in the hot-rolled steel sheet for gas nitrocarburizing, it is assumed that gas nitrocarburizing treatment is performed when the steel sheet is used as a part. Therefore, not only toughness of an original sheet (a hot-rolled steel sheet in which the gas nitrocarburizing treatment is not performed) but also sufficient impact resistance (toughness) after the gas nitrocarburizing treatment (may be simply referred to as after nitriding treatment) are required. In general, due to influences such as a compound phase generated on a surface, in the hot-rolled steel after the gas nitrocarburizing treatment, compared to the hot-rolled steel sheet before the gas nitrocarburizing treatment, impact resistance is deteriorated. In the hot-rolled steel sheet according to the present embodiment, by setting the toughness of the original sheet to be greater than or equal to a target value and controlling a nitride layer, it is investigated that the toughness of the hot-rolled steel sheet after the gas nitrocarburizing treatment is also set to be a target value or more.

In addition, in the present embodiment, a case, which is simply referred to as impact resistance or toughness, indicates impact resistance or toughness of both of the original sheet and the sheet after nitriding treatment.

As a result of the investigation, the following new findings are obtained.

In order to improve isotropy (decrease anisotropy), avoiding formation of transformation texture from non-recrystallization austenite which is a cause of the anisotropy is effective. Thus, it is preferable to promote recrystallization of austenite after finish rolling. In addition, as the measures for the promotion, an optimum rolling pass schedule at the finish rolling and an increase of rolling temperature are effective.

On the other hand, also before the nitriding treatment and after the nitriding treatment, in order to improve impact resistance (toughness), refining of a fracture unit of a brittle fracture face, that is, grain refining of a microstructure unit is effective. For the grain refining, increasing a nucleation site of a at the time of transformation of γ (austenite)→α (ferrite) is effective. Accordingly, it is preferable to increase grain boundaries or dislocation density of the austenite which can be the nucleation site. In order to increase the grain boundaries or the dislocation density, it is preferable that the rolling is performed at greater than or equal to γ→α transformation point temperature and at temperature as low as possible. In other words, it is preferable to perform the γ→α transformation in a state where austenite is non-recrystallized and a non-recrystallization ratio is high. This is because growth of austenite grains after the recrystallization is fast at recrystallization temperature, and thus, the austenite grains coarsen for a very short time and grain coarsening occurs even at a phase after the $\gamma \rightarrow \alpha$ transformation.

The inventors considered that it was difficult to satisfy both the isotropy and the toughness since preferable conditions are contrary to each other in the above-described general hot rolling measures. Whereas, the inventors found a new hot rolling method capable of obtaining a steel sheet which balances the isotropy and the impact resistance in a high standard.

The inventors obtain the following findings with respect to a relationship between the isotropy and the texture.

When a steel sheet is processed to a part which requires circularity or uniformity of a sheet thickness in a circumferential direction, in order to obtain the uniformity of the sheet thickness and the circularity which satisfy characteristics of a part as processed by omitting a process of trimming or cutting, it is preferable that an isotropy index $1/|\Delta r|$ which is an index of the isotropy is 3.5 or more. As shown in FIG. 1, in order to make the isotropy index be 3.5 or more, average pole density of a orientation group of {100}<011> to {223}<110> in a center portion of a sheet thickness which is a range of the sheet thickness of ⅝ to ⅜ from a surface of the steel sheet is 4.0 or less in the texture of the steel sheet. If the average pole density is more than 4.0, anisotropy becomes significantly strong. On the other hand, the average pole density is less than 1.0, there is a concern that hole expansibility is deteriorated due to deterioration of local deformability. In order to obtain further improved isotropy index 6.0, it is more preferable that the average pole density of the orientation group of {100}<011> to {223}<110> be 2.0 or less. When the isotropy is 6.0 or more, even in a case where dispersion in a coil is considered, the uniformity of the sheet thickness and the circularity, which sufficiently satisfy part characteristics as processed, are obtained. Here, the average pole density of the orientation group of {100}<011> to {223}<110> is an orientation group which is represented by an arithmetic average of each orientation of {100}<011>, {116}<110>, {114}<110>, {112}<110>, and {223}<110>. Therefore, the average pole density of the orientation group of {100}<011> to {223}<110> can be obtained by arithmetically averaging the pole density of each orientation of {100}<011>, {116}<110>, {114}<110>, {112}<110>, and {223}<110>.

The isotropy index is obtained according to a test method described in JIS Z 2241 by processing No. 5 test piece described in JIS Z 2201 and testing. In $1/|\Delta r|$ which is the isotropy index, if plastic strain ratios (r values) of a rolling direction, and 45° direction and 90° direction (sheet width direction) with respect to the rolling direction are defined as r0, r45, and r90 respectively, $|\Delta r|$ is defined as $\Delta r=(r0-2\times r45+r90)/2$. Moreover, $|\Delta r|$ indicates an absolute value of $\Delta r$.

The pole density of each orientation is measured using a method such as Electron Back Scattering Diffraction Pattern (EBSP method). Specifically, the pole density may be obtained from a three-dimensional texture which is calculated by a vector method based on a {110} pole figure or a three-dimensional texture which is calculated by a series expansion method using a plurality of pole figures (preferably, three or more pole figures) of {100}, {110}, {211}, and {310} pole figures.

Figure 2:
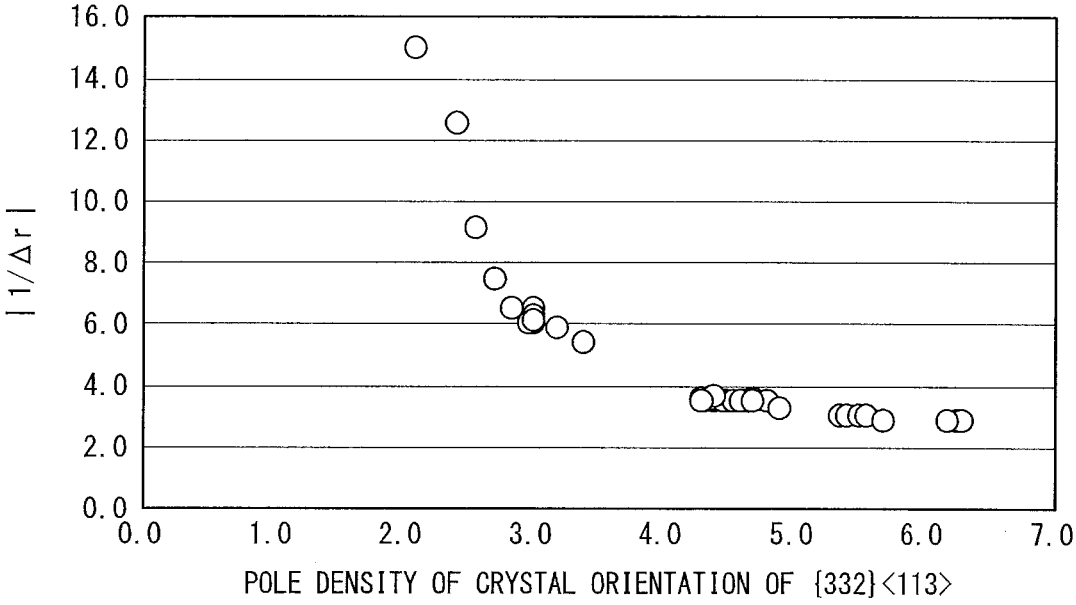
FIG. 2 is a view showing a relationship between a pole density of a crystal orientation of {332}<113> and isotropy.

Similarly, as shown in FIG. 2, in order to make the isotropy index $1/|\Delta r|$ be 3.5 or more, the pole density of the crystal orientation of {332}<113> in the center portion of the sheet thickness which is a range of the sheet thickness of ⅝ to ⅜ from a surface of the steel sheet is set to 4.8 or less in the texture of the steel sheet. If the pole density is more than 4.8, anisotropy becomes significantly strong. On the other hand, the pole density is less than 1.0, there is a concern that hole expansibility is deteriorated due to deterioration of the local deformability. In order to obtain 6.0 or more which is further improved isotropy index, it is more preferable that the pole density of the crystal orientation of {332}<113> is 3.0 or less. When the value of the isotropy index is 6.0 or more, even in a case where dispersion in a coil is considered, since the uniformity of the sheet thickness and the circularity, which sufficiently satisfy part characteristics as processed, are obtained, it is more preferable that the value of the isotropy index is 6.0 or more.

In addition, the average pole density of the orientation group of {100}<011> to {223}<110> and the pole density of the crystal orientation of {332}<113> are increased in a case of intentionally making a ratio of grains toward the crystal orientation be higher than other orientations.

In addition, if the average pole density and the pole density are decreased, workability such as the hole expansibility is improved. In addition, it is preferable that the hole expansibility is 70% or more.

The above-described pole density is synonymous with an X-ray random intensity ratio. The X-ray random intensity ratio is a value which is obtained by measuring X-ray intensity of a standard sample which does not have integration in a specific orientation and a sample material in the same conditions by X-ray diffraction method or the like, and by dividing the X-ray intensity of the standard sample by the obtained X-ray intensity of the sample material. The pole density can be measured by any method of an X-ray diffraction, an EBSP method, or an Electron Channeling Pattern (ECP) method. For example, the pole density of the orientation group {100}<011> to {223}<110> is obtained by obtaining the pole density of each orientation of {100}<011>, {116}<110>, {114}<110>, {112}<110>, and {223}<110> from the three-dimensional texture (ODF) which is calculated by a series expansion method using a plurality of pole figures of {110}, {100}, {211}, and {310} pole figures measured by the above-described methods, and by arithmetically averaging the pole density. To prepare the sample which is supplied to the EBSP or the like, the thickness of the steel sheet is decreased to a predetermined sheet thickness from the surface by mechanical polishing or the like. Subsequently, strain is removed by chemical polishing, electrolytic polishing, or the like, and the sample may be adjusted and measured according to the above-described methods so that a proper surface at the range of ⅝ to ⅜ of the sheet thickness is the measurement surface. In a sheet width direction, it is preferable that the sample is collected at a position of ¼ or ¾ from an end of the steel sheet. In addition, the pole density is not changed before and after the gas nitrocarburizing treatment.

Of course, when the above-described limitation of the pole density satisfies not only the center portion of the sheet thickness but also thickness, as much as possible, the local deformability is further improved. However, since the orientation integration in the sheet thickness of ⅜ to ⅝ from the surface of the steel sheet most largely influences the anisotropy of a product, performing the measurement of the center portion of the sheet thickness which is the range of the sheet thickness of ⅝ to ⅜ from the surface of the steel sheet can approximately represent material characteristics of the entire steel sheet. Therefore, the average pole density of the orientation group of {100}<011> to {223}<110> and the pole density of the crystal orientation of {332}<113>, in the center portion of the sheet thickness which is the range of the sheet thickness of ⅝ to ⅜ from the surface of the steel sheet, are defined.

Here, {hkl}<uvw> indicates that a normal direction of the sheet surface is parallel to {hkl} and the rolling direction is parallel to <uvw> when the sample is collected by the above-described method. In addition, generally, in the orientation of the crystal, an orientation perpendicular to the sheet surface is represented by [hkl] or {hkl} and an orientation parallel in the rolling direction is represented by (uvw) or <uvw>. {hkl} and <uvw> are collective terms of equivalent planes, and [hkl] and (uvw) indicate respective crystal planes. That is, for example, since the present embodiment has a body-centered cubic structure as a target, (111), (−111), (1−11), (11−1), (−1−11), (−11−1), (1−1−1), and (−1−1−1) planes are equivalent and are not classified. In this case, the orientation is referred to as {111} as the collective term. In the ODF display, since the orientation of the crystal is used for orientation displays of other crystal structures having low symmetry, generally, each orientation is represented by [hkl](uvw). However, in the present embodiment, [hkl](uvw) and {hkl}<uvw> are synonymous with each other.

Next, the inventors examine impact resistance (toughness).

The temperature of vTrs of the original sheet and vTrs after nitriding treatment is decreased with decreases in the average grain sizes. That is, toughness is improved. Moreover, the vTrs after nitriding is affected by a pearlite fraction or the like in addition to the average grain size. In the hot-rolled steel sheet according to the present embodiment, when the vTrs after nitriding is −20° C. or less which is a temperature capable of enduring as a nitrided part under a cold climate, it is found that the hot-rolled steel sheet preferably includes a composition range described in the present embodiment, in the hot-rolled steel sheet in which the pearlite fraction is preferably 6% or more, and the average grain size in the center portion of the sheet thickness is preferably 10 μm or less. In addition, when it is assumed that the steel sheet is used in a strict environment and thus, the vTrs after nitriding is −40° C. or less, it is preferable that the average grain size in the center portion of the sheet thickness be 7 μm or less.

The impact resistance (toughness) is evaluated by vTrs (Charpy fracture appearance transition temperature) which is obtained by V notch Charpy impact test. Here, in the V notch Charpy impact test, a test piece is manufactured based on JIS Z 2202, the Charpy impact test is performed to the test piece according to the content defined in JIS Z 2242, and thus, the vTrs is measured.

As described above, the average grain size in the center portion of the sheet thickness of the structure largely influences the impact resistance (toughness). The measurement of the average grain size in the center portion of the sheet thickness is performed as follows. A micro-sample is cut from near the center portion in the sheet thickness direction of the steel sheet, and grain sizes are measured using an EBSP-OIM (registered trademark) (Electron Back Scatter Diffraction Pattern-Orientation Image Microscopy). The micro-sample is ground for 30 to 60 minutes using colloidal silica abrasives, and the EBSP measurement is performed under a measurement condition of a magnification of 400, an area of 160 μm×256 μm, and a measurement step of 0.5 μm.

The EBSP-OIM (registered trademark) method measures the crystal orientation of an irradiation point for a short waiting time by radiating electron beams to a largely inclined sample in a scanning electron microscope (SEM), photographing a Kikuchi pattern, which is backscattered and formed, by a high sensitive camera, and by performing a computer image processing to the pattern.

In the EBSP method, a microstructure of and the crystal orientation of a bulk sample surface can be quantitatively analyzed, and an analysis area can be analyzed by resolution of the SEM or resolution of minimum 20 nm in an area which can be also observed by the SEM. The analysis is performed by mapping the area to be analyzed according to tens of thousands of points in a grid shape with equal intervals for several hours. In a polycrystalline material, the crystal orientation distribution or sizes of the grains in the sample can be viewed.

In the present embodiment, 15°, which is a threshold of a high angle grain boundary which is generally recognized as a grain boundary in orientation differences of the grains, is defined as a grain boundary, and the average grain size is obtained by visualizing the grains from the mapped image. That is, the "average grain size" is a value which can be obtained by EBSP-OIM (registered trademark).

As described above, the inventors clarified each condition for obtaining the isotropy and the impact resistance.

That is, the average grain size, which is directly related to the impact resistance, is decreased with a decrease of finish rolling ending temperature. However, the average pole density of the orientation group of {100}<011> to {223}<110> which is represented by an arithmetic average of the pole density of each orientation of {100}<011>, {116}<110>, {114}<110>, {112}<110>, and {223}<110>, and the pole density of the crystal orientation of {332}<113>, in a center portion of the sheet thickness which is a range of the sheet thickness of ⅝ to ⅜ from the surface of the steel sheet, which are controlling factors of the isotropy, have a reverse correlation with the average grain size with respect to the finish rolling temperature. Thereby, a technique which satisfies both the isotropy and the impact resistance has not been shown at all until now.

Thus, the inventors searched hot rolling methods and conditions which simultaneously improve the isotropy and the impact resistance by sufficiently recrystallizing austenite after the finish rolling for the isotropy and suppressing growth of the recrystallized grains as much as possible.

In order to recrystallize the austenite grains which become a worked structure by the rolling, it is preferable that the finish rolling is performed at an optimum temperature range and by a large rolling-reduction ratio of 50% or more in total. On the other hand, in order to perform grain refining to the microstructure of a product sheet, it is preferable to suppress the grain growth after the recrystallization of austenite grains as much as possible by starting cooling of the sheet within a fixed period of time after the finish rolling ends.

Thus, temperature which is determined by the component of the steel sheet represented by the above-described Equation (b) is T1(° C.), the hot rolling of total rolling-reduction ratio R is performed at a temperature range of T1+30° C. or more and T1+200° C. or less, and a waiting time t second until cooling, in which cooling temperature change is 40° C. or more and 140° C. or less by a cooling rate of 50° C./second or more and the cooling ending temperature becomes T1+100° C. or less, is performed from the hot rolling ending is obtained. In addition, a relationship between the waiting time and "the average pole density of the orientation group of {100}<011> to {223}<110> in a center portion of the sheet thickness which is the range of the sheet thickness of ⅝ to ⅜ from the surface of the steel sheet in the texture of the steel sheet and the average grain size at the center of the sheet thickness", which are requirements of the hot-rolled steel sheet according to the present embodiment, is examined. In addition, all R is 50% or more. The total rolling-reduction ratio (total of the rolling-reduction ratios) is synonymous with a so-called accumulated rolling-reduction ratio, and is a percentage of accumulated rolling-reduction ratio (a difference between the inlet sheet thickness before the initial pass in the rolling at each temperature range and an outlet sheet thickness after the final pass in the rolling at each temperature range) with respect to a reference based on an inlet sheet thickness before an initial pass in the rolling at each temperature range.

As represented by the above-described Equation (c), when the waiting time t until performing of the cooling by the cooling rate of 50° C./second or more after ending the hot rolling of the total rolling-reduction ratio R in the temperature range of T1+30° C. or more and T1+200° C. or less is within t1×2.5 seconds, in a case where the cooling temperature change is 40° C. or more and 140° C. or less and the cooling ending temperature is T1+100° C. or less, "the average pole density of the orientation group of {100}<011> to {223}<110> is 1.0 or more and 4.0 or less and the pole density of the crystal orientation of {332}<113> is 1.0 or more and 4.8 or less, in the texture of the steel sheet, and in the center portion of the sheet thickness which is the range of the sheet thickness of ⅝ to ⅜ from the surface of the steel sheet", and "the average grain size at the center in the sheet thickness is 10 μm or less" are satisfied. That is, it is considered that the isotropy and the impact resistance, which are the object of the present embodiment, are satisfied.

This indicates that the range which improves both the isotropy and the impact resistance, that is, the range, which satisfies both sufficient recrystallization and grain refining of the austenite, can be achieved by a hot rolling method which is specified by the present embodiment described in detail below.

In addition, when the average grain size is 7 μm or less with an object of further improving the toughness, it is found that the waiting time t second is preferably less than t1, and when the average pole density of the orientation group of {100}<011> to {223}<110> is 2.0 or less with an object of further improving the isotropy, it is found that the waiting time t second is preferably t1 or more and 2.5×t1 or less.

Moreover, based on the findings obtained by the basic research described as above, the inventors have diligently investigated with respect to a hot-rolled steel sheet for gas nitrocarburizing which is suitably applied to the member which requires ductility and strict uniformity of the sheet thickness, the circularity, and the impact resistance after processing and a manufacturing method of the hot-rolled steel sheet. As a result, the hot-rolled steel sheet including the following conditions and the manufacturing method thereof are conceived.

Limitation reasons of chemical composition in the present embodiment will be described.

C Content [C]: More than 0.07% and Equal to or Less than 0.2%

C is an element which largely influences strength and pearlite fraction of a base metal. However, C is also an element which generates iron-based carbide such as cementite ($Fe_3C$) which becomes origins of cracks at the time of hole expansion. When the C content [C] is 0.07% or less, effects of improvement in strength achieved by structure strengthening due to a low-temperature transformation forming phase cannot be obtained. On the other hand, when the C content is more than 0.2%, center segregation is remarkably generated, and thus, the iron-based carbide such as cementite ($Fe_3C$), which becomes origins of cracks of a secondary shear surface at the time of punching, is increased, and punching quality or hole expansibility is deteriorated. Thereby, the C content [C] is limited to a range of more than 0.07% and equal to or less than 0.2%. When balance between ductility and strength in addition to the improvement in the strength is considered, the C content [C] is preferably 0.15% or less.

Si Content [Si]: 0.001% or More and 2.5% or Less

Si is an element which contributes an increase in strength of the base metal. Moreover, Si has a role as a deoxidizer material of molten steel. The effects are exerted when the Si content [Si] is 0.001% or more. However, even when the Si content is more than 2.5%, the effect contributing the increase in the strength is saturated. Si is an element which largely influences transformation point temperature, when the Si content [Si] is less than 0.001% or is more than 2.5%, there is a concern that generation of pearlite may be suppressed. Thereby, the Si content [Si] is limited to a range of 0.001% or more and 2.5% or less. In addition, from the viewpoint of the improvement in the strength and improvement in the hole expansibility, Si is added to be more than 0.1%, and thus, according to the increase of the Si content, precipitation of the iron-based carbide such as cementite in the structure of the steel sheet is suppressed, which contributes the improvement in the strength and improvement in the hole expansibility. On the other hand, if the added amount is more than 1%, the effect which suppresses the precipitation of the iron-based carbide is saturated. Accordingly, a preferable range of the Si content [Si] is more than 0.1% and equal to or less than 1%.

Mn Content [Mn]: 0.01% or More and 4% or Less

Mn is an element which contributes the improvement in the strength by solute strengthening and quenching strengthening. However, if the Mn content [Mn] is less than 0.01%, the effect cannot be obtained. On the other hand, the effect is saturated if the Mn content is more than 4%. Moreover, Mn is an element which largely influences the transformation point temperature, and when the Mn content [Mn] is less than 0.01% or more than 4%, there is a concern that generation of pearlite may be suppressed. Thereby, the Mn content [Mn] is limited to a range of 0.01% or more and 4.0% or less. When elements other than Mn are not sufficiently added to suppress occurrence of hot cracks due to S, it is preferable that the Mn content [Mn] and the S content [S] satisfy, by mass %, [Mn]/[S]≥20. In addition, Mn is an element which improves hardenability by enlarging austenite region temperature to a low temperature side according to the increase of the Mn content, and makes a continuous cooling transformation structure having an improved burring property is easily formed. Since this effect is not easily exerted when the Mn content [Mn] is less than 1%, it is preferable that the Mn content be added 1% or more.

P Content [P]: More than 0% and Equal to or Less than 0.15%

P is impurity contained in molten iron, and is an element which is segregated on grain boundaries and decreases toughness according to an increase in the content. Therefore, it is desirable that the P content be as low as possible. If the P content is more than 0.15%, P adversely affects workability or weldability, and thus, the P content is limited so as to be 0.15% or less. Particularly, considering hole expansibility or weldability, the P content is preferably 0.02% or less. Since it is difficult that the content of P becomes 0% because of operational problems, the content [P] of P does not include 0%.

S Content [S]: More than 0% and Equal to or Less than 0.03%

S is impurity which is contained in molten iron, and is an element which not only decrease toughness or generates cracks at the time of hot rolling but also generates A type inclusion which deteriorates hole expansibility if the content is too large. Thereby, the S content should be decreased as much as possible. However, since the S content of 0.03% or less is an allowable range, the S content is limited to be 0.03% or less. In addition, in a case where some extent of hole expansibility is needed, the S content [S] is preferably 0.01% or less, and more preferably 0.005% or less. Since it is difficult that the content of S becomes 0% because of operational problems, the content [S] of S does not include 0%.

Al Content [Al]: 0.001% or More and 2% or Less

Al of 0.001% or more is added for deoxidation of molten steel in a refining process of steel. However, since a large amount of addition increase costs, the upper limit is 2%. Moreover, if too large of an amount of Al is added, nonmetallic inclusion is increased, and ductility and toughness are deteriorated. Therefore, from the viewpoint of the ductility and the toughness, the Al content is preferably 0.06% or less. More preferably, the Al content is 0.04% or less. Similar to Si, in order to obtain the effect which suppresses the precipitation of iron-based carbide such as cementite in the material structure, it is preferable that the Al content of 0.016% or more is contained. Accordingly, it is more preferable that the Al content [Al] is 0.016% or more and 0.04% or less.

N Content [N]: More than 0% and Equal to or Less than 0.01%

N generates coarse TiN with Ti at the time of casting, and decreases a surface hardness improvement effect by Ti at the time of gas nitrocarburizing. Therefore, N should be decreased as much as possible. However, the N content of 0.01% or less is an allowable range. From the viewpoint of aging resistance, it is more preferable that the N content be 0.005% or less. Since making the N content be 0% is difficult in the operational aspect, 0% is not included.

$$Ti\ \text{content}[Ti]:0.005+[N]\times 48/14+[S]\times 48/32\leq[Ti]\quad 0.015+[N]\times 48/14+[S]\times 48/32 \tag{a}$$

Ti added to be precipitated as Tic after ferrite transformation, and is added to suppress growth of α grains by a pinning effect during cooling or after coiling. However, Ti is precipitated and fixed as TiN, TiS, or the like in high temperature range of an austenite phase. Therefore, in order to secure Ti effective in the pinning in a α phase, the Ti content is added to be greater than or equal to 0.005+[N]×48/14+[S]×48/32. On the other hand, even when the Ti content is added to be more than 0.015+[N]×48/14+[S]×48/32, the effect is saturated, and thus, 0.015+[N]×48/14+[S]×48/32 is the upper limit. In addition, since Ti fixes C with TiC, if Ti is excessively added, there is a concern that generation of pearlite may be suppressed.

Moreover, Ti is bonded to N in gas nitrocarburizing treatment after forming and has an effect which increases hardness. Therefore, Ti is added to be greater than or equal to 0.005+[N]×48/14+[S]×48/32. If the Ti content [Ti] is less than 0.005+[N]×48/14+[S]×48/32, since chipping resistance and rolling fatigue resistance are decreased after the gas nitrocarburizing treatment, therefore, even though the steel sheet has a sufficient mechanical characteristics as an original sheet, the steel sheet is insufficient as the hot-rolled steel sheet for gas nitrocarburizing.

The above-described chemical elements are basic components (basic elements) of the steel in the present embodiment, and a chemical composition, in which the basic elements are controlled (contained or limited) and the balance consists of Fe and unavoidable impurities, is the basic composition of the present embodiment. However, in the present embodiment, in addition to (instead of a portion of Fe of the balance) the basic components, if necessary, one kind or two or more kinds of Nb, Cu, Ni, Mo, V, Cr, Ca, Mg, REM, and B may be further contained. In addition, even when the selective elements are inevitably (for example, amount less than the lower limit of the amount of each selective element) mixed into the steel, the effects in the present embodiment are not damaged. Hereinafter, limitation reasons of the component of each element will be described.

Nb, Cu, Ni, Mo, V, and Cr are elements having an effect which improves strength of the hot-rolled steel sheet by precipitation strengthening or solute strengthening. However, when the Nb content [Nb] is less than 0.005%, the Cu content [Cu] is less than 0.02%, the Ni content [Ni] is less than 0.01%, the Mo content [Mo] is less than 0.01%, the V content [V] is less than 0.01%, and the Cr content [Cr] is less than 0.01%, the effect cannot be sufficiently obtained. Moreover, even when the Nb content [Nb] is added to be more than 0.06%, the Cu content [Cu] is added to be more than 1.2%, the Ni content [Ni] is added to be more than 0.6%, the Mo content [Mo] is added to be more than 1%, the V content [V] is added to be more than 0.2%, and the Cr content [Cr] is added to be more than 2%, the effect is saturated, and economic efficiency is decreased. Accordingly, when Nb, Cu, Ni, Mo, V, and Cr are contained if necessary, it is preferable that the Nb content [Nb] is 0.005% or more and 0.06% or less, the Cu content [Cu] is 0.02% or more and 1.2% or less, the Ni content [Ni] is 0.01% or more and 0.6% or less, the Mo content [Mo] is 0.01% or more and 1% or less, the V content [V] is 0.01% or more and 0.2% or less, and the Cr content [Cr] is 0.01% or more and 2% or less.

Mg, Ca, and REM (Rare Earth Element: Rare Earth Metal) are elements which improve workability by controlling the shape of nonmetallic inclusion which becomes origins of breaks and causes deterioration of workability. If Ca, REM, and Mg are added less than 0.0005% respectively, the effect is not exerted. In addition, even when the Mg content [Mg] is added to be more than 0.01%, the Ca content [Ca] is added to be more than 0.01%, and the REM content [REM] is added to be more than 0.1%, the effect is saturated, and economic efficiency is decreased. Accordingly, it is preferable that the Mg content [Mg] is added 0.0005% or more and 0.01% or less, the Ca content [Ca] is added 0.0005% or more and 0.01% or less, and the REM content [REM] is added 0.0005% or more and 0.1% or less.

B Content [B]: 0.0002% or More and 0.002% or Less

B is bonded to N in gas nitrocarburizing treatment after forming and has an effect which increases hardness. However, if B is added to be less than 0.0002%, the effect cannot be obtained. On the other hand, if B is added to be more than 0.002%, the effect is saturated. Moreover, since B is an element which suppresses recrystallization of austenite in the hot rolling, if a large amount of B is added, γ→α, transformation texture is strengthened from non-recrystallization austenite, and thus, there is a concern that isotropy may be deteriorated. Thereby, the B content [B] is 0.0002% or more and 0.002% or less. On the other hand, from the viewpoint of slab cracks in the cooling process after continuous casting, the [B] is preferably 0.0015% or less. That is, the B content [B] is more preferably 0.001% or more and 0.0015% or less.

Moreover, in the hot-rolled steel sheet which has the above-described elements as main components, Zr, Sn, Co, Zn, and W may be contained to 1% or less in total as unavoidable impurities. However, since there is a concern that scratches may occur due to Sn at the time of the hot rolling, Sn is preferably 0.05% or less.

Next, metallurgical factors such as microstructure in the hot-rolled steel sheet according to the present embodiment will be described in detail.

The microstructure of the hot-rolled steel sheet according to the present embodiment includes, by structural fraction, pearlite more than 6% and ferrite in the balance. The limitation of the structural configuration is related to toughness after nitriding treatment, that is, impact resistance when is used as a part after the gas nitrocarburizing treatment.

The gas nitrocarburizing treatment is performed at relatively low temperature of approximately 570° C. which is less than or equal to the $\alpha \rightarrow \gamma$ transformation point temperature. That is, unlike quenching processing, the gas nitrocarburizing treatment is not the processing which strengthens the structure by quenching using phase transformation, and is the processing which is remarkably hardened by forming nitride having high hardness.

When a cross-section of a material which is subjected to the gas nitrocarburizing treatment, is observed by a microscope, a compound layer (white layer: £ nitride $Fe_{2-3}N$) having thickness of approximately 10 to 20 μm and a diffusion layer having thickness of approximately 100 to 300 μm in the deep portion can be confirmed. Moreover, a base metal structure, which is not almost changed compared to before the treatment, exists in the further deep portion. In addition, the compound layer is a brittle layer, and since there is a concern that toughness after nitriding treatment may be decreased if the compound layer is too deep, the compound layer is preferably 20 μm or less.

Moreover, in order to satisfy chipping resistance and rolling fatigue resistance in the part which is subjected to the gas nitrocarburizing treatment, average Vickers hardness Hv (0.005 kgf) in the position of 0 μm to 5 μm from the surface in the compound layer after the gas nitrocarburizing requires hardness of 350 Hv or more. From the viewpoint of abrasive resistance, the average Vickers hardness is more preferably 400 Hv or more.

In the gas nitrocarburizing treatment,

N which is obtained from a reaction of $2NH_3 \leftrightarrow 2N+3H_2$ is diffused on the surface of the steel sheet and forms nitride. At this time, in the compound of Fe and N, there are two kinds of γ' phase ($Fe_4N$) of a face-centered cubic lattice and ζ phase ($Fe_2N$) of a closed-packed hexagonal lattice, and the phase is generated if N concentration is more than 11%. The ζ phase deteriorate the toughness after the nitriding treatment significantly.

In order to satisfy both of wear resistance, seize resistance, fatigue resistance, corrosion resistance, or the like which is obtained by the gas nitrocarburizing treatment and toughness after nitriding treatment, generation of the ζ phase should be avoided by controlling the diffusion of N.

The inventors have diligently repeated research with respect to a method, which avoids generation of the ζ phase if possible by suppressing the diffusion of N, from the viewpoint of metallography. As a result, the inventors newly found that the diffusion of N is suppressed and generation of the ζ phase can be avoided if pearlite more than 6% by structural faction exists in the microstructure.

Although this mechanism has not been clear, it is considered that this is because C exists much in Fe lattices in ferrite which exits in a state which is sandwiched to band-like cementite lamellars forming a pearlite structure, C occupies invasion sites of N which is to be diffused into Fe lattices at the gas nitrocarburizing treatment, and thus, the diffusion of N is suppressed.

The upper limit of the structural fraction of pearlite in the hot-rolled steel sheet according to the present embodiment is not particularly limited. However, since the composition range of the hot-rolled steel sheet according to the present embodiment is a range which becomes hypo-eutectoid steel, 25% becomes the upper limit.

Lamellar spacing of pearlite in the hot-rolled steel sheet according to the present embodiment is not particularly limited. However, when the lamellar spacing is more than 2 μm, concentration of C, which exists in Fe lattice of the ferrite existing in a state sandwiched to the cementite lamellar, is decreased, and the effect which suppresses the diffusion of N may be decreased. Therefore, the lamellar spacing of pearlite is preferably 2 μm or less, more preferably 1.5 μm or less, and still more preferably 1.0 μm or less.

A measurement of the lamellar spacing is performed as follows. After the steel sheet is etched by NITAL, the sheet is observed at least 5 or more fields at a magnification of 5,000 times or more by SEM, and thus, the lamellar spacing of the pearlite structure is measured. The lamellar spacing in the present embodiment indicates the average value.

Next, the reasons for limitation of a manufacturing method of the hot-rolled steel sheet according to the present embodiment will be described in detail below (hereinafter, referred to as a manufacturing method according to the present embodiment).

In the manufacturing method according to the present embodiment, a steel piece such as a slab including the above-described components is manufactured prior to the hot rolling process. The manufacturing method of the steel piece is not particularly limited. That is, as the manufacturing method of the steel piece including the above-described components, a melting process is performed at a blast furnace, converter, an electric furnace, or the like, subsequently, component adjustment is performed by various secondary refining processes to obtain the intended component content, subsequently, a casting process may be performed by a method such as thin-slab casting in addition to casting by general continuous casting or an ingot method. When the slab is obtained by the continuous casting, the slab may be sent to a hot rolling mill in a state of a high temperature cast slab, and the slab is reheated in the heating furnace after being cooled to room temperature and thereafter, hot rolling may be performed to the slab. Scraps may be used for a raw material.

The slab which is obtained by the above-described manufacturing method is heated in a slab heating process before the hot rolling process. In the manufacturing method according to the present embodiment, the heating temperature is not particularly limited. However, if the heating temperature is more than 1260° C., since yield is decreased due to scale-off, the heating temperature is preferably 1260° C. or less. Moreover, in the heating temperature which is less than 1150° C., since operation efficiency in a schedule is significantly damaged, the heating temperature is preferably 1150° C. or more.

Heating time in the slab heating process is not particularly limited. However, from the viewpoint of avoiding center segregation or the like, it is preferable that the heating of the slab is maintained for 30 minutes or more after reaching the above-described heating temperature. However, the heating time is not applied to a case where the cast slab after casting is directly sent in a high temperature state and is rolled.

Without waiting in particular after the slab heating process, for example, a rough rolling process, which performs rough rolling (first hot rolling) to the slab which is extracted from the heating furnace within 5 minutes, starts, and thus, a rough bar is obtained.

Due to the reasons described below, the rough rolling (first hot rolling), includes once or more of reduction with reduction ratio of 40% or more at a temperature range of 1000° C. or more and 1200° C. or less. When the rough rolling temperature is less than 1000° C., hot deformation resistance is increased in the rough rolling, and there is a concern that the operation of the rough rolling may be damaged.

On the other hand, when the rough rolling temperature is more than 1200° C., the average grain size is increased, and toughness is decreased. Moreover, a secondary scale which is generated in the rough rolling is too grown, and thus, there is a concern that the scale may be not easily removed by descaling or the finish rolling which is performed later. When rough rolling ending temperature is more than 1150° C., inclusion extends, and thus, hole expansibility may be deteriorated. Therefore, the rough rolling ending temperature is preferably 1150° C. or less.

In addition, if the rolling-reduction ratio is small in the rough rolling, the average grain size is increased, and thus, toughness is decreased. Preferably, if the rolling-reduction ratio is 40% or more, the grain size is more uniform and fine. On the other hand, when the rolling-reduction ratio is more than 65%, the inclusion extends, and thus, hole expansibility may be deteriorated. Therefore, the upper limit is preferably 65%.

In order to refine the average grain size of the hot-rolled steel sheet, the austenite grain size after the rough rolling, that is, before finish rolling (second hot rolling) is important. Therefore, the austenite grain size is preferably 200 μm or less. Refining and homogenization of grains of the hot-rolled steel sheet are largely promoted by decreasing the sizes of the austenite grains before the finish rolling. In order to make the austenite grain size be is 200 μm or less, rolling reduction of 40% or more is performed once or more.

In order to more efficiently obtain the effects of the grain refining and the homogenization, the austenite grain size is preferably 100 μm or less. Thereby, it is preferable that the rolling reduction of 40% or more is performed twice or more in the rough rolling (first hot rolling). However, if a number of the rolling reduction is more than ten times, there is a concern that a decrease in the temperature or excessive generation of the scales may occur.

In this way, decreasing the austenite grain size before the finish rolling is effective for promotion of recrystallization of austenite in the finish rolling later. It is assumed that this is because austenite grain boundaries after the rough rolling (that is, before the finish rolling) function as one of recrystallized nuclei during the finish rolling. In this way, appropriately controlling the time until the finish rolling and cooling starting after decreasing the austenite grain size as described below is effective for the refining of the average grain size in the steel sheet.

In order to confirm the austenite grain size after the rough rolling, it is preferable to cool the steel sheet as rapidly as possible before the sheet enters the finish rolling. That is, the steel sheet is cooled at a cooling rate of 10° C./s or more, the austenite grain boundaries stand out by etching the structure of the cross-section, and thus, the steel sheet is measured by an optical microscope. At this time, 20 or more fields are measured at magnification of 50 times or more by image analysis or a intercept method.

In the rolling (a second hot rolling and a third hot rolling) which is performed after the rough rolling completion, endless rolling may be performed in which the rolling is continuously performed by joining the rough bars, which are obtained after the rough rolling process ends, between the rough rolling process and the finish rolling process. At this time, the rough bars are temporarily coiled in a coil shape, the coiled rough bar is stored in a cover having a thermal insulation function if necessary, and the joining may be performed by recoiling the rough bar.

Moreover, when the finish rolling (a second hot rolling) is performed, it may be preferable that dispersion of temperature in a rolling direction, a sheet width direction, and a sheet thickness direction of the rough bar is controlled to be decreased. In this case, if necessary, the rough bar may be heated by a heating device which can control the dispersion of the temperature in the rolling direction, the sheet width direction, and the sheet thickness direction of the rough bar between a rough rolling mill of the rough rolling process and a finish rolling mill of the finish rolling process, or between respective stands in the finish rolling process.

As heating measures, various heating measures such as gas heating, electrical heating, or induction heating is considered. However, if the dispersion of the temperature in the rolling direction, the sheet width direction, and the sheet thickness direction of the rough bar can be controlled to be decreased, any well-known measures may be used. As the heating device, an induction heating device having industrially improved control responsiveness of temperature is preferable. Particularly, in the induction heating device, if a plurality of transverse type induction heating devices which can be shifted in the sheet width direction are installed, since the temperature distribution in the sheet width direction can be arbitrarily controlled according to the sheet width, the transverse induction heating devices are more preferable. As the heating device, a device, which is configured by combining the transverse induction heating device and a solenoid induction heating device which excellently heats the overall sheet width, is most preferable.

When temperature is controlled using the above-described heating devices, it is preferable to control a heating amount by the heating device. In this case, since the temperature of the inner portion of the rough bar cannot be actually measured, the temperature distribution in the rolling direction, the sheet width direction, and the sheet thickness direction when the rough bar reaches the heating device is assumed using previously measured results data such as the temperature of a charged slab, staying time in the furnace of the slab, heating furnace atmosphere temperature, heating furnace extraction temperature, and transportation time of a table roller. In addition, it is preferable to control the heating amount by the heating device based on the respective assumed values.

For example, the control of the heating amount by the induction heating device is performed as follows.

As properties of the induction heating device (transverse type induction heating device), when alternating current flows to a coil, a magnetic field is generated in the inner portion. Moreover, in a conductor disposed in the coil, an eddy current in a direction opposite to the coil current is generated in a circumferential direction perpendicular to a magnetic flux by electromagnetic induction action, and the conductor is heated by Joule heat. The eddy current is most strongly generated on the surface of the inside of the coil and is exponentially decreased toward the inside (this phenomenon is referred to as skin effect).

Therefore, a current penetration depth is increased with a decrease in frequency, and thus, a uniform heating pattern can be obtained in the thickness direction. Conversely, the current penetration depth is decreased with an increase in frequency, and it is known that an excessively heated small heating pattern, which has the surface in the thickness direction as the peak, is obtained.

Therefore, the heating in the rolling direction and the sheet width direction of the rough bar can be performed similar to the conventional method by the transverse induction heating device.

In the heating in the sheet thickness direction, homogenization of the temperature distribution can be performed by changing a penetration depth by the frequency change of the transverse induction heating device and operating the heating pattern in the sheet thickness direction.

In this case, a frequency variable induction heating device is preferably used. However, the frequency change may be performed by adjusting a capacitor. In the control of the heating amount by the induction heating device, a plurality of inductors having different frequencies are disposed, and allocation of each heating amount may be changed to obtain the required heating pattern in the thickness direction. In the control of the heating amount by the induction heating device, the frequency is changed when an air gap between a material to be heated and the heating device is changed. Therefore, desired frequency and heating pattern may be obtained by changing the air gap.

In addition, for example, as described in Metal Material Fatigue Design Manual (edited by Soc. of Materials Sci., Japan), there is a correlation between fatigue strength of the steel sheet which is hot-rolled or pickled and a maximum height Ry of the steel sheet surface. Therefore, it is preferable that the maximum height Ry (corresponding to Rz defined in JIS B0601:2001) of the steel sheet surface after the finish rolling is 15 μm (15 μmRy, I 2.5 mm, ln 12.5 mm) or less. In order to obtain the surface roughness, it is preferable that a condition of collision pressure P of high-pressure water on the steel sheet surface×a flow rate L≥0.003 is satisfied in the descaling. In order to prevent scales from occurring again, it is preferable that the subsequent finish rolling is performed within 5 seconds after the descaling.

After the rough rolling (the first hot rolling) process ends, the finish rolling (the second hot rolling) process starts. Here, the time from the ending of the rough rolling to the starting of the finish rolling is set to 150 seconds or less. If the time from the ending of the rough rolling to the starting of the finish rolling is more than 150 seconds, the average grain size in the steel sheet is increased, and thus, toughness is decreased. The lower limit of the time is not particularly limited. However, when recrystallization is completely completed after the rough rolling, the time is preferably 5 seconds or more. Moreover, in a case where a temperature decrease of the rough bar surface due to roll contact and influence to the material due to unevenness of the temperature in the sheet thickness direction of the rough bar by generation of heat at the time of processing are concerned, the time is preferably 20 seconds or more.

In the finish rolling, a starting temperature of the finish rolling is set to 1000° C. or more. If the starting temperature of the finish rolling is less than 1000° C., the rolling temperature of the rough bar to be rolled is decreased in each finish rolling pass, the rolling reduction is preformed at a non-recrystallization temperature range, the texture is developed, and isotropy is deteriorated.

The upper limit of the starting temperature of the finish rolling is not particularly limited. However, if the starting temperature is more than 1150° C. or more, there is a concern that blisters which become origins of scale-like spindle scale defects may occur between ferrite of the steel sheet and the surface scale before the finish rolling and between passes. Therefore, it is preferable that the starting temperature of the finish rolling is less than 1150° C.

In the finish rolling, when temperature determined by components of the steel sheet is represented by T1(° C.), the rolling reduction of 30% or more by one pass is performed at least once in a temperature range of T1+30° C. or more and T1+200° C. or less, and total of the rolling-reduction ratio at the temperature range is set to 50% or more, and the hot rolling ends at T1+30° C. or more. Here, Ti is temperature which is calculated by the following Equation (b) using the content of each element.

$$T1=850+10\times([C]+[N])\times[Mn]+350\times[Nb]+250\times[Ti]+40\times[B]+10\times[Cr]+100\times[Mo]+100\times[V] \quad (b)$$

The T1 temperature itself is obtained empirically. The inventors empirically found that recrystallization is promoted at an austenite range of each steel based on the T1 temperature in an experiment. However, an amount of chemical elements (chemical composition) which are not included in Equation (b) is regarded as 0%, and the calculation is preformed.

If the total rolling-reduction ratio is less than 50% at the temperature range of T1+30° C. or more and T1+200° C. or less, since rolling strain accumulated in the hot rolling is not sufficient and recrystallization of austenite does not sufficiently proceed, the grain size is coarsened, texture is developed, and thus, isotropy is deteriorated. Therefore, the total rolling-reduction ratio in the finish rolling is set to 50% or more. If the total rolling-reduction ratio is preferably 70% or more, sufficient isotropy is obtained even if dispersion due to temperature change or the like is considered.

On the other hand, if the total rolling-reduction ratio is more than 90%, due to generation of heat at the time of processing or the like, it is difficult to maintain the temperature range of T1+200° C. or less. Therefore, the total rolling-reduction ratio of 90% or more is not preferable. In addition, if the total rolling-reduction ratio is more than 90% a rolling load increased, and thus, the rolling may not be easily performed.

In addition, in order to promote uniform recrystallization by opening of the accumulated strain, after total of the rolling-reduction ratio at T1+30° C. or more and T1+200° C. or less is set to 50% or more, the rolling reduction of 30% or more by one pass is performed at least once during the rolling.

After the second hot rolling ends, in order to promote uniform recrystallization, it is preferable that a processing amount at a temperature range equal to or more than the Ar3 transformation point temperature and less than T1+30° C. is suppressed to be decreased if possible. Therefore, a total of the rolling-reduction ratio in the rolling (third hot rolling) at the temperature range equal to or more than the Ar3 transformation point temperature and less than T1+30° C. is limited to 30% or less. From the viewpoint of accuracy of the sheet thickness or the sheet shape, a rolling-reduction ratio of 10% or less is preferable. However, when isotropy is further required, the rolling-reduction ratio of 0% is more preferable.

The first rolling to the third hot rolling is needs to be ended at the Ar3 transformation point temperature or more. In the hot rolling of less than the Ar3 transformation point temperature, the hot rolling becomes dual phase rolling, and isotropy and ductility are decreased due to residual of the processing ferrite structure. In addition, rolling ending temperature is preferably T1° C. or more.

Moreover, in order to suppress growth of recrystallized grains, when a pass having rolling-reduction ratio of 30% or more at temperature range of T1+30° C. or more and T1+200° C. or less is defined as a large rolling-reduction pass, and a primary cooling, in which the cooling temperature change is 40° C. or more and 140° C. or less and the cooling stop temperature is T1+100° C. or less, is preformed at a cooling rate of 50° C./second or more so that a waiting time t (second) from completion of the final pass of the large rolling-reduction passes to start of the cooling satisfies the following Equation (c).

If the waiting time t until the cooling is more than 2.5×t1 seconds, since the recrystallized austenite grains are maintained at high temperature, the grains are significantly grown, and as a result, toughness is deteriorated. In addition, in order to water-cool the steel sheet rapidly, if possible, after the rolling, it is preferable that the primary cooling is performed between rolling stands. In addition, when an instrumental device such as a thermometer or a sheet thickness meter is installed on a rear surface of a final rolling stand, since the measurement is difficult due to steam or the like which is generated when cooling water is applied, it is difficult to install a cooling device immediately behind the final rolling stand.

$$t \leq 2.5 \times t1 \quad \text{(c)}$$

$$t1 = 0.001 \times ((Tf - T1) \times P1/100)^2 - 0.109 \times ((Tf - T1) \times P1/100) + 3.1 \quad \text{(d)}$$

Here, Tf is the temperature (° C.) after the final pass rolling reduction of the large rolling-reduction passes and P1 is the rolling-reduction ratio (%) of the final pass of the large rolling-reduction passes.

In addition, the waiting time t is not the time from ending of the hot rolling, and it is found that setting the waiting time as described above is preferable since a preferable recrystallization ratio and recrystallized grain size can be obtained. Moreover, if the waiting time until the start of the cooling is set as described above, either the primary cooling or the third hot rolling may be performed in advance.

By limiting the cooling temperature change to 40° C. or more and 140° C. or less, the growth of recrystallized austenite grains can be further suppressed. In addition, by more efficiently controlling variant selection (avoidance of variant limitation), the development of the texture can be further suppressed. If the temperature change of the primary cooling is less than 40° C., the recrystallized austenite grains are grown, and toughness is deteriorated. On the other hand, if the temperature change is more than 140° C., there is a concern that the temperature may be overshot to the Ar3 transformation point temperature or less, and in this case, the variant selection is rapidly performed even at transformation from the recrystallized austenite, and as a result, texture is formed and isotropy is decreased. Moreover, when the cooling stop temperature is the Ar3 transformation point temperature or less, a bainite structure is generated, and there is a concern that generation of ferrite and pearlite may be suppressed.

If the cooling rate during cooling is less than 50° C./second, the recrystallized austenite grains are grown and toughness is deteriorated. The upper limit of the cooling rate is not particularly limited. However, from the viewpoint of the sheet shape, it is properly considered that the upper limit is 200° C./second or less. In addition, if the steel sheet temperature at the end of cooling ending is more than T1+100° C., cooling effects cannot be sufficiently obtained. For example, this is because even though the primary cooling is performed under appropriate conditions after the final pass, there is a concern that grain growth may occur and the austenite grain size may be significantly coarsened when the steel sheet temperature after the end of primary cooling is more than T1+100° C.

Moreover, when the waiting time t until the start of cooling is limited to be less than t1, the grain growth is further suppressed, and more improved toughness can be obtained.

On the other hand, the waiting time t until the start of the cooling is further limited to satisfy t1≤t≤2.5×t1, randomization of grains is sufficiently promoted, and a stable and further improved pole density and isotropy can be obtained.

Moreover, in order to suppress the grain growth and obtain improved toughness, in the rolling of a temperature range of T1+30° C. or more and T1+200° C. or less, it is preferable that temperature increase between respective finish rolling passes is 18° C. or less. For example, in order to suppress the temperature increase, a cooling device between passes or the like may be used.

Regarding whether or not the rolling specified as above is performed, a rolling-reduction ratio can be obtained from actual results or calculation from measurements of the rolling load and the sheet thickness, or the like. In addition, the temperature can be measured if the thermometer between stands is provided, or since calculation simulation which considers generation of heat at the time of processing from a line speed, the rolling-reduction ratio, or the like can be performed, whether or not the rolling defined as above is performed can be obtained from either the rolling ratio or the temperature or both.

In the manufacturing method according to the present embodiment, rolling speed is not particularly limited. However, if the rolling speed at the final finishing stand is less than 400 mpm, γ grains tend to be grown and coarsened. Accordingly, regions capable of performing precipitation of ferrite to obtain ductility are decreased, and thus, there is a concern that ductility may be deteriorated. Moreover, effects can be obtained even if the upper limit of the rolling speed is not particularly limited. For installation limitation, 1800 mpm or less is reasonably practical. Accordingly, it is preferable that the rolling speed in the finish rolling process be 400 mpm or more and 1800 mpm or less if necessary.

Moreover, after the primary cooling, before the coiling process and after passing through the rolling stand, the secondary cooling may be performed. The cooling pattern is not particularly limited and may be appropriately set according to the line speed or coiling temperature in a range which satisfies the coiling temperature described below.

Subsequently, in the coiling process, the coiling temperature is more than 550° C. If the coiling temperature is 550° C. or less, the coiling temperature becomes Bs point or less, bainite is mixed into the microstructure, and there is a concern that impact resistance after the nitriding treatment may be deteriorated. Moreover, after the coiling, the pearlite transformation does not sufficiently proceed. The upper limit of the coiling temperature is not particularly limited. However, the upper limit is not higher than the rolling ending temperature. Moreover, when the upper limit is more than 850° C., since there is a concern that steel sheet surface characteristics may be deteriorated due to oxidation of the outermost circumference of the coil, the upper limit is preferably 850° C. or less. The upper limit is more preferably 800° C. or less.

However, when the lamellar spacing of the pearlite structure is set to 2 μm or less, the coiling temperature is preferably 800° C. or less. When the lamellar spacing is 1.5 μm or less, the coiling temperature is more preferably 700° C. or less. The pearlite structure is mainly generated in the coiling process, and the lamellar spacing of the pearlite is largely affected by diffusion distances of Fe and C.

In addition, with an object of improving the ductility by correction of the steel sheet shape or introduction of moving dislocation, after all rolling processes end, skin pass rolling having the rolling-reduction ratio of 0.1% or more and 2% or less may be performed. In addition, after all processes end, with an object of removing scales attached to the surface of the obtained hot-rolled steel sheet, pickling may be performed to the obtained hot-rolled steel sheet if necessary. Moreover, after the pickling, a skin pass or cooling rolling having the rolling-reduction ratio of 10% or less may be performed to the obtained hot-rolled steel sheet at an in-line or an off-line.

In the hot-rolled steel sheet according to the present embodiment, even in any case after the casting, the hot rolling, and the cooling, heat treatment may be performed to the steel sheet at a hot-dip plating line, and a separate surface processing may be performed to the hot-rolled steel sheet. By performing the plating at the hot-dip plating line, corrosion resistance of the hot-rolled steel sheet is improved. When galvanizing is performed to the hot-rolled steel sheet after pickling, the obtained steel sheet is immersed in a galvanizing bath, and alloying treatment may be performed if necessary. By performing the alloying treatment, in the hot-rolled steel sheet, the corrosion resistance is improved and weld resistance with respect to various welding such as spot welding is improved.

Figure 3:
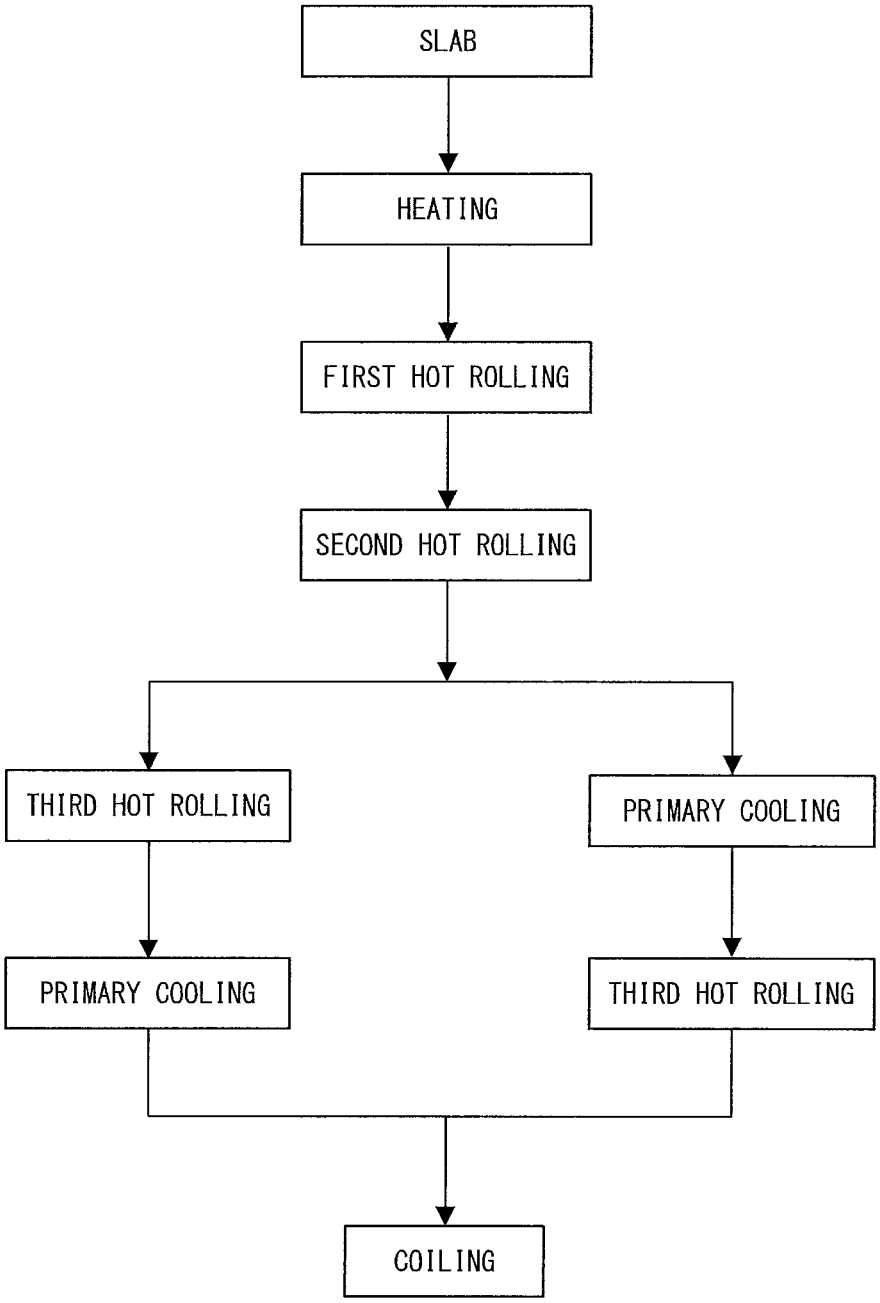
FIG. 3 is a flowchart showing a manufacturing method of a hot-rolled steel sheet according to the present embodiment.

For reference, FIG. 3 is a flowchart showing an outline of the manufacturing method according to the present embodiment.

In addition, gas nitrocarburizing treatment is performed to the obtained hot-rolled steel sheet after the processes are completed, and thus, a nitrided part is obtained.

EXAMPLE

Hereinafter, the present invention is further described based on Example.

Theast slabs of A to AI having chemical compositions shown in Table 1 were manufactured via a converter, a secondary refining process, and continuous casting. Then, the cast slabs were reheated, were rolled to a sheet thickness of 2.0 mm to 3.6 mm at the finish rolling continuous to the rough rolling, were subjected to the primary cooling, and were coiled after being subjected to the secondary cooling if necessary, and thus, hot-rolled steel sheets were manufactured. More specifically, according to manufacturing conditions shown in Tables 2 to 7, the hot-rolled steel sheets were manufactured. In addition, gas nitrocarburizing treatment, which is heated and maintained for 5 hours at 560° C. to 580° C. in atmosphere of ammonia gas+$N_2$+$CO_2$, were performed to the hot-rolled steel sheet. Moreover, all indications of the chemical compositions in Tables are mass %.

In addition, the balance of components in Table 1 indicate Fe and unavoidable impurities, and "0%" or "-" indicates that Fe and unavoidable impurities are not detected. Moreover, underlines in Tables indicate ranges out of the range of the present invention.

Here, a "component" represents the steels including the component corresponding to each symbol shown in Table 1, "Ar3 transformation point temperature" represents the Ar3 temperature (° C.) which is calculated by the following Equation (g), and "Ti" represents the temperature which is calculated by the Equation (b), and "t1" represents the times which is calculated by the Equation (d).

$$Ar3=910-310\times[C]+25\times[Si]-80\times[Mneq] \quad (g)$$

Here, [Mneq] is indicated by the following Equation (h) when B is not added and by the following Equation (i) when B is added.

$$[Mneq]=[Mn]+[Cr]+[Cu]+[Mo]+[Ni]/2+10\times([Nb]-0.02) \quad (h)$$

$$[Mneq]=[Mn]+[Cr]+[Cu]+[Mo]+[Ni]/2+10\times([Nb]-0.02)+1 \quad (i)$$

Here, [component element] is amount of a component element which is represented by mass %.

"Heating temperature" represents the heating temperature in the cast slab heating process, "holding time" represents the holding time at a predetermined heating temperature in the heating process, the "number of times of rolling reduction of 40% or more at 1000° C. or more" or a "rolling-reduction ratio of 40% or more at 1000° C. or more" represents the rolling-reduction ratio or the number of times of rolling reduction of a pass of 40% or more in a temperature range of 1000° C. or more and 1200° C. or less in the rough rolling, "time until starting of finish rolling" represents the time from the rough rolling process ending to the finish rolling process starting, and "total rolling-reduction ratio" represents the total rolling-reduction ratio in the hot rolling of each temperature range. In addition, "Tr" represents the temperature after the final pass rolling reduction of the large rolling-reduction pass, "P1" represents the rolling-reduction ratio of the final pass of the large rolling reduction pass", "maximum temperature increase between passes" represents a maximum temperature which is increased by the generation of heat at the time of processing or the like between passes at the temperature range of T1+30° C. or more and T1+200° C. or less. In addition, in the Example, the finish rolling ended at the final rolling reduction of 30% or more except for a case where P1 was "-" Tf is the finish rolling ending temperature except for the case where P1 was "-"

Moreover, "waiting time until primary cooling starting" represents the waiting time from completion of the final pass of the large rolling-reduction passes to start of cooling when the pass having rolling-reduction ratio of 30% or more at the temperature range of T1+30° C. or more and T1+200° C. or less is set to a large rolling-reduction pass, "primary cooling rate" represents an average cooling rate from primary cooling temperature starting to the completion of the primary cooling, "primary cooling temperature change" represents a difference between the starting temperature of primary cooling and the ending temperature of primary cooling, and "coiling temperature" represents the temperature when the steel sheet is coiled by a coiler in the coiling process.

Evaluation results of the obtained steel sheets are shown in Tables 8 to 10. Among mechanical properties, with respect to tensile properties, isotropy, and hole expansibility, evaluation was performed to an original sheet. With respect to toughness, evaluation was performed to both the original sheet and the hot-rolled steel sheet after nitriding treatment.

Moreover, as evaluations of the chipping resistance and the rolling fatigue resistance after gas nitrocarburizing treatment, average hardness (Hv(0.005 kgf)) from the surface of the compound layer after the gas nitrocarburizing to 5 μm was examined. An evaluation method of the steel sheet is the same as the above-described method. Here, "pearlite fraction" indicates an area fraction of the pearlite structure which is measured by a point counter method from an optical microscope structure, "average grain size" indicates the average grain size which is measured by EBSP-OIM™, "average pole density of orientation group of {100}<011> to {223}<110>" indicates the pole density of the orientation group of {100}<011> to {223}<110> parallel to the rolling surface, "pole density of crystal orientation of {332}<113>" indicates the pole density of the crystal orientation of {332}<113> parallel to the rolling surface, "compound layer depth after gas nitrocarburizing" indicates the depth (thickness) of a compound layer (white layer: ε nitride $Fe_{2-3}N$) which collects a cross-section micro-sample from the surface, observed by a microscope, and measures after performing the gas nitrocarburizing treatment which heated and maintained for 5 hours at 560° C. to 580° C. in atmosphere of ammonia gas+$N_2$+$CO_2$. In addition, the pearlite fraction indicates the approximately same value even when the fraction is measured in the surface portion and the center portion of the sheet thickness.

Results of "tensile test" indicate results of C direction using JIS No. 5 test piece. In Tables, "YP" indicates a yield point, "TS" indicates tensile strength, and "El" indicates elongation respectively. "Isotropy" has a reciprocal of |Δr| as the index. Results of "hole expansion" indicate the results which can be obtained by a hole expansion test method described in JFS T 1001: 1996. "Toughness" indicates a transition temperature (vTrs) which is obtained by a subsize V-notch Charpy test.

The hot-rolled steel sheets according to the present invention are steel Nos. 8, 13, 15, 16, 24 to 28, 30, 31, 34 to 37, 40 to 42, 56, 61, 63, 64, 72 to 76, 78, 79, 82 to 85, and 88 to 90. The steel sheets contain a predetermined amount of steel component and hot-rolled steel sheets for gas nitrocarburizing in which the average pole density of the orientation group of {100}<011> to {223}<110> is 1.0 or more and 4.0 or less and the pole density of the crystal orientation of {332}<113> is 1.0 or more and 4.8 or less, in the texture of the steel sheet in the center portion of the sheet thickness which is the range of the sheet thickness of ⅝ to ⅜ from the surface of the steel sheet, and the average grain size at the center in the sheet thickness is 10 μm or less, and the hot-rolled steel sheets are microstructures which include, by structural fraction, pearlite more than 6% and ferrite in the balance, and have tensile strength 440 MPa or more. Moreover, the hot-rolled steel sheets have improved isotropy, toughness after nitriding treatment, toughness of the original sheet and the average hardness from the surface of the compound layer after gas nitrocarburizing to 5 μm, and hole expansibility.

TABLE 1

| STEEL | C | Si | Mn | P | S | Al | N | Ti | Nb | Cu | Ni | Mass % Mo |
|---|---|---|---|---|---|---|---|---|---|---|---|---|
| A | 0.069 | 1.20 | 2.51 | 0.016 | 0.003 | 0.023 | 0.0026 | 0.144 | 0.020 | 0.00 | 0.00 | 0.00 |
| B | 0.071 | 1.17 | 2.46 | 0.011 | 0.002 | 0.029 | 0.0040 | 0.179 | 0.017 | — | — | — |
| C | 0.067 | 0.14 | 1.98 | 0.007 | 0.001 | 0.011 | 0.0046 | 0.091 | 0.038 | — | — | — |
| D | 0.036 | 0.94 | 1.34 | 0.008 | 0.001 | 0.020 | 0.0028 | 0.126 | 0.041 | — | — | — |
| E | 0.043 | 0.98 | 0.98 | 0.010 | 0.001 | 0.036 | 0.0034 | 0.099 | — | — | — | — |
| F | 0.042 | 0.73 | 1.04 | 0.011 | 0.001 | 0.024 | 0.0041 | 0.035 | 0.019 | — | — | — |
| G | 0.089 | 0.91 | 1.20 | 0.008 | 0.001 | 0.033 | 0.0038 | 0.000 | — | — | — | — |
| H | 0.180 | 0.03 | 0.72 | 0.017 | 0.004 | 0.011 | 0.0035 | 0.025 | — | — | — | — |
| I | 0.022 | 0.05 | 1.12 | 0.009 | 0.004 | 0.025 | 0.0047 | 0.102 | 0.00 | 0.00 | 0.00 | 0.00 |
| J | 0.004 | 0.12 | 1.61 | 0.080 | 0.002 | 0.041 | 0.0027 | 0.025 | 0.025 | 0.00 | 0.00 | 0.00 |
| K | 0.230 | 0.18 | 0.74 | 0.017 | 0.002 | 0.005 | 0.0051 | 0.000 | — | — | — | — |
| L | 0.091 | 0.02 | 1.50 | 0.007 | 0.001 | 0.011 | 0.0046 | 0.026 | — | 0.06 | 0.03 | — |
| M | 0.100 | 0.03 | 1.45 | 0.008 | 0.001 | 0.020 | 0.0028 | 0.020 | — | — | 0.03 | — |
| N | 0.081 | 0.01 | 1.51 | 0.010 | 0.001 | 0.036 | 0.0034 | 0.022 | — | — | — | 0.48 |
| O | 0.090 | 0.02 | 1.55 | 0.011 | 0.001 | 0.020 | 0.0041 | 0.024 | 0.011 | — | — | — |
| P | 0.087 | 0.02 | 1.52 | 0.008 | 0.001 | 0.033 | 0.0038 | 0.023 | — | — | — | — |
| Q | 0.220 | 0.12 | 1.25 | 0.012 | 0.005 | 0.026 | 0.0041 | 0.028 | — | — | — | — |
| R | 0.145 | 0.15 | 1.22 | 0.011 | 0.004 | 0.024 | 0.0040 | 0.025 | — | — | — | — |
| S | 0.075 | 0.18 | 1.24 | 0.010 | 0.010 | 0.030 | 0.0044 | 0.036 | — | — | — | — |
| T | 0.067 | 0.24 | 1.28 | 0.009 | 0.003 | 0.022 | 0.0043 | 0.025 | — | — | — | — |
| U | 0.142 | 2.65 | 1.25 | 0.007 | 0.001 | 0.036 | 0.0034 | 0.018 | — | — | — | — |
| V | 0.144 | 2.42 | 1.22 | 0.008 | 0.001 | 0.020 | 0.0041 | 0.021 | — | — | — | — |
| W | 0.151 | 0.95 | 1.24 | 0.010 | 0.001 | 0.033 | 0.0038 | 0.020 | — | — | — | — |
| X | 0.146 | 0.11 | 1.28 | 0.011 | 0.001 | 0.026 | 0.0035 | 0.019 | — | — | — | — |
| Y | 0.143 | 0.01 | 1.22 | 0.008 | 0.004 | 0.024 | 0.0047 | 0.027 | — | — | — | — |
| Z | 0.149 | 0.00 | 1.24 | 0.012 | 0.004 | 0.030 | 0.0027 | 0.020 | — | — | — | — |
| AA | 0.144 | 0.12 | 4.60 | 0.012 | 0.002 | 0.036 | 0.0051 | 0.025 | — | — | — | — |
| AB | 0.145 | 0.14 | 3.80 | 0.011 | 0.002 | 0.020 | 0.0046 | 0.024 | — | — | — | — |
| AC | 0.146 | 0.14 | 1.10 | 0.010 | 0.001 | 0.033 | 0.0028 | 0.016 | — | — | — | — |
| AD | 0.139 | 0.11 | 0.02 | 0.009 | 0.001 | 0.026 | 0.0034 | 0.018 | — | — | — | — |
| AE | 0.141 | 0.18 | 0.00 | 0.007 | 0.001 | 0.024 | 0.0041 | 0.021 | — | — | — | — |
| AF | 0.144 | 0.16 | 1.22 | 0.200 | 0.001 | 0.030 | 0.0038 | 0.020 | — | — | — | — |
| AG | 0.145 | 0.15 | 1.24 | 0.002 | 0.040 | 0.022 | 0.0037 | 0.078 | — | — | — | — |
| AH | 0.149 | 0.13 | 1.24 | 0.011 | 0.005 | 0.023 | 0.0042 | 0.040 | — | — | — | — |
| AI | 0.141 | 0.12 | 1.22 | 0.011 | 0.004 | 0.026 | 0.0045 | 0.020 | — | — | — | — |

| STEEL | V | Cr | B | Mg | Ca | Rem | OTHERS | REMARKS |
|---|---|---|---|---|---|---|---|---|
| A | 0.00 | 0.00 | 0.0014 | 0.0022 | — | — | — | COMPARATIVE STEEL |
| B | — | — | — | — | 0.0024 | — | — | COMPARATIVE STEEL |

TABLE 1-continued

| | | | | | | | | |
|---|---|---|---|---|---|---|---|---|
| C | — | — | — | 0.0019 | — | — | — | COMPARATIVE STEEL |
| D | — | — | — | — | — | — | — | COMPARATIVE STEEL |
| E | — | — | — | — | 0.0021 | — | — | COMPARATIVE STEEL |
| F | — | — | — | — | — | 0.0018 | — | COMPARATIVE STEEL |
| G | — | — | — | — | 0.0022 | — | — | COMPARATIVE STEEL |
| H | — | — | — | — | — | — | — | THE PRESENT INVENTION |
| I | 0.00 | 0.00 | 0.0011 | — | — | 0.0020 | — | COMPARATIVE STEEL |
| J | 0.00 | 0.00 | 0.0011 | — | — | 0.0020 | — | COMPARATIVE STEEL |
| K | — | — | — | — | — | 0.0020 | — | COMPARATIVE STEEL |
| L | — | — | — | — | — | — | — | THE PRESENT INVENTION |
| M | — | — | — | — | — | — | — | THE PRESENT INVENTION |
| N | — | — | — | — | — | — | — | THE PRESENT INVENTION |
| O | 0.10 | — | — | — | — | — | — | THE PRESENT INVENTION |
| P | — | 0.91 | — | — | — | — | — | THE PRESENT INVENTION |
| Q | — | — | — | — | — | — | — | COMPARATIVE STEEL |
| R | — | — | — | 0.0012 | — | — | — | THE PRESENT INVENTION |
| S | — | — | — | — | — | 0.0020 | — | THE PRESENT INVENTION |
| T | — | 2.40 | — | — | — | — | — | COMPARATIVE STEEL |
| U | — | — | — | — | — | — | — | COMPARATIVE STEEL |
| V | — | — | — | — | 0.0022 | — | — | THE PRESENT INVENTION |
| W | — | — | — | — | — | — | — | THE PRESENT INVENTION |
| X | — | — | — | — | — | — | Co: 0.001 | THE PRESENT INVENTION |
| Y | — | — | — | — | — | — | — | THE PRESENT INVENTION |
| Z | — | — | — | — | — | — | — | COMPARATIVE STEEL |
| AA | — | — | — | — | — | — | — | COMPARATIVE STEEL |
| AB | — | — | — | — | — | — | — | THE PRESENT INVENTION |
| AC | — | — | — | — | — | — | Zr: 0.002 | THE PRESENT INVENTION |
| AD | — | — | — | — | — | — | — | THE PRESENT INVENTION |
| AE | — | — | — | — | — | — | — | COMPARATIVE STEEL |
| AF | — | — | — | — | — | — | — | COMPARATIVE STEEL |
| AG | — | — | — | — | — | — | — | COMPARATIVE STEEL |
| AH | — | — | — | — | — | — | — | COMPARATIVE STEEL |
| AI | — | — | — | — | — | — | — | COMPARATIVE STEEL |

TABLE 2

| | STEEL NO. | METALLURGICAL FACTOR (1) | (2) | T1 (° C.) | MANUFACTURING CONDITION: HEATING TEMPERATURE CONDITION (3) | (4) | FIRST HOT ROLLING (5) | (6) | (7) | (8) | (9) | SECOND HOT ROLLING (10) | (11) | Tf (° C.) | P1 (%) | (12) | (13) |
|---|---|---|---|---|---|---|---|---|---|---|---|---|---|---|---|---|---|
| COMPARATIVE EXAMPLE | 1 | A | 638 | 895 | 1260 | 45 | 2 | 45/45 | 100 | 1090 | 60 | 1080 | 90 | 990 | 40 | 1 | 15 |
| COMPARATIVE EXAMPLE | 2 | B | 723 | 903 | 1260 | 45 | 2 | 45/45 | 100 | 1090 | 60 | 1080 | 90 | 990 | 40 | 1 | 12 |
| COMPARATIVE EXAMPLE | 3 | C | 720 | 887 | 1230 | 45 | 3 | 40/40/40 | 80 | 1060 | 60 | 1050 | 93 | 980 | 35 | 2 | 15 |
| COMPARATIVE EXAMPLE | 4 | D | 798 | 896 | 1200 | 60 | 3 | 40/40/40 | 80 | 1030 | 90 | 1020 | 89 | 990 | 32 | 3 | 12 |
| COMPARATIVE EXAMPLE | 5 | E | 779 | 875 | 1200 | 60 | 3 | 40/40/40 | 80 | 1030 | 90 | 1020 | 89 | 970 | 32 | 3 | 12 |
| COMPARATIVE EXAMPLE | 6 | F | 833 | 866 | 1200 | 60 | 3 | 40/40/40 | 80 | 1030 | 90 | 1020 | 89 | 960 | 32 | 3 | 12 |
| COMPARATIVE EXAMPLE | 7 | G | 825 | 851 | 1200 | 60 | 3 | 40/40/40 | 80 | 1030 | 90 | 1020 | 89 | 950 | 32 | 3 | 12 |
| THE PRESENT INVENTION | 8 | H | 813 | 858 | 1200 | 60 | 1 | 50 | 150 | 1030 | 90 | 1020 | 89 | 980 | 35 | 2 | 15 |
| COMPARATIVE EXAMPLE | 9 | H | 813 | 858 | 1200 | 60 | 0 | — | 250 | 1030 | 60 | 1020 | 93 | 980 | 35 | 2 | 15 |
| COMPARATIVE EXAMPLE | 10 | H | 813 | 858 | 1200 | 60 | 1 | 50 | 150 | 1030 | 180 | 1020 | 93 | 980 | 35 | 2 | 15 |
| COMPARATIVE EXAMPLE | 11 | H | 813 | 858 | 1200 | 60 | 1 | 50 | 150 | 1030 | 60 | 1020 | 45 | 980 | 35 | 2 | 15 |
| COMPARATIVE EXAMPLE | 12 | H | 813 | 858 | 1200 | 60 | 1 | 50 | 150 | 1030 | 60 | 1020 | 93 | 800 | 35 | 2 | 15 |
| THE PRESENT INVENTION | 13 | H | 813 | 858 | 1200 | 60 | 1 | 50 | 150 | 1030 | 30 | 1020 | 93 | 1050 | 35 | 2 | 15 |
| COMPARATIVE EXAMPLE | 14 | H | 813 | 858 | 1200 | 60 | 1 | 50 | 150 | 1030 | 60 | 1020 | 93 | 980 | — | 0 | 15 |
| THE PRESENT INVENTION | 15 | H | 813 | 858 | 1200 | 60 | 1 | 50 | 150 | 1030 | 60 | 1020 | 93 | 980 | 35 | 2 | 25 |
| THE PRESENT INVENTION | 16 | H | 813 | 858 | 1200 | 60 | 1 | 50 | 150 | 1030 | 60 | 1020 | 93 | 980 | 35 | 2 | 15 |
| COMPARATIVE EXAMPLE | 17 | H | 813 | 858 | 1200 | 60 | 1 | 50 | 150 | 1030 | 60 | 1020 | 93 | 980 | 35 | 2 | 15 |
| COMPARATIVE EXAMPLE | 18 | H | 813 | 858 | 1200 | 60 | 1 | 50 | 150 | 1030 | 60 | 1020 | 93 | 980 | 35 | 2 | 15 |
| COMPARATIVE EXAMPLE | 19 | H | 813 | 858 | 1200 | 60 | 1 | 50 | 150 | 1030 | 60 | 1020 | 93 | 980 | 35 | 2 | 15 |
| COMPARATIVE EXAMPLE | 20 | H | 813 | 858 | 1200 | 60 | 1 | 50 | 150 | 1030 | 60 | 1020 | 93 | 980 | 35 | 2 | 15 |
| COMPARATIVE EXAMPLE | 21 | I | 751 | 876 | 1200 | 60 | 3 | 40/40/40 | 80 | 1030 | 90 | 1020 | 89 | 960 | 32 | 3 | 12 |
| COMPARATIVE EXAMPLE | 22 | J | 699 | 865 | 1200 | 60 | 3 | 40/40/40 | 80 | 1030 | 90 | 1020 | 89 | 950 | 32 | 3 | 12 |
| COMPARATIVE EXAMPLE | 23 | K | 800 | 852 | 1200 | 60 | 3 | 40/40/40 | 80 | 1030 | 90 | 1020 | 89 | 940 | 32 | 3 | 12 |
| THE PRESENT INVENTION | 24 | L | 772 | 858 | 1180 | 90 | 3 | 40/40/40 | 80 | 1010 | 90 | 1000 | 89 | 960 | 32 | 3 | 12 |
| THE PRESENT INVENTION | 25 | M | 779 | 856 | 1180 | 90 | 3 | 40/40/40 | 80 | 1010 | 90 | 1000 | 89 | 950 | 32 | 3 | 12 |
| THE PRESENT INVENTION | 26 | N | 662 | 905 | 1180 | 90 | 3 | 40/40/40 | 80 | 1010 | 90 | 1000 | 89 | 940 | 32 | 3 | 12 |
| THE PRESENT INVENTION | 27 | O | 766 | 871 | 1180 | 90 | 3 | 40/40/40 | 80 | 1010 | 90 | 1000 | 89 | 950 | 32 | 3 | 12 |
| THE PRESENT INVENTION | 28 | P | 705 | 866 | 1180 | 90 | 3 | 40/40/40 | 80 | 1010 | 90 | 1000 | 89 | 940 | 32 | 3 | 12 |
| COMPARATIVE STEEL | 29 | Q | 761 | 860 | 1250 | 30 | 1 | 50 | 160 | 1080 | 120 | 1070 | 90 | 950 | 40 | 1 | 11 |

TABLE 2-continued

| | STEEL NO. | METALLURGICAL FACTOR (1) | (2) | T1 (° C.) | MANUFACTURING CONDITION: HEATING TEMPERATURE CONDITION (3) | (4) | FIRST HOT ROLLING (5) | (6) | (7) | (8) | (9) | SECOND HOT ROLLING (10) | (11) | Tf (° C.) | P1 (%) | (12) | (13) |
|---|---|---|---|---|---|---|---|---|---|---|---|---|---|---|---|---|---|
| THE PRESENT INVENTION | 30 | R | 787 | 858 | 1250 | 30 | 1 | 50 | 160 | 1080 | 120 | 1070 | 90 | 950 | 40 | 1 | 11 |

(1) COMPONENT
(2) Ar3 TRANSFORMATION POINT TEMPERATURE (° C.)
(3) HEATING TEMPERATURE (° C.)
(4) HOLDING TIME (MINUTE)
(5) NUMBER OF TIMES OF ROLLING REDUCTION OF 40% OR MORE AT 1000° C. OR MORE
(6) ROLLING-REDUCTION RATIO OF 40% OR MORE AT 1000° C. OR MORE (%)
(7) γ GRAIN SIZE (μm)
(8) ROLLING ENDING TEMPERATURE (° C.)
(9) TIME UNTIL FINISH ROLLING STARTING (SECOND)
(10) ROLLING STARTING TEMPERATURE (° C.)
(11) TOTAL ROLLING-REDUCTION RATIO (%)
(12) NUMBER OF TIMES OF PASS HAVING 30% OR MORE BY ONE PASS
(13) MAXIMUM TEMPERATURE INCREASE BETWEEN PASSES (° C.)

TABLE 3

| | STEEL NO. | METALLURGICAL FACTOR (1) | (2) | T1 (° C.) | MANUFACTURING CONDITION: HEATING TEMPERATURE CONDITION (3) | (4) | FIRST HOT ROLLING (5) | (6) | (7) | (8) | (9) | SECOND HOT ROLLING (10) | (11) | TF (° C.) | P1 (%) | (12) | (13) |
|---|---|---|---|---|---|---|---|---|---|---|---|---|---|---|---|---|---|
| THE PRESENT INVENTION | 31 | S | 808 | 858 | 1250 | 30 | 1 | 50 | 160 | 1080 | 120 | 1070 | 90 | 950 | 40 | 1 | 11 |
| COMPARATIVE STEEL | 32 | T | 617 | 881 | 1250 | 30 | 1 | 50 | 160 | 1080 | 120 | 1070 | 90 | 950 | 40 | 1 | 11 |
| COMPARATIVE STEEL | 33 | U | 847 | 856 | 1250 | 30 | 1 | 50 | 160 | 1080 | 120 | 1070 | 90 | 950 | 40 | 1 | 11 |
| THE PRESENT INVENTION | 34 | V | 844 | 857 | 1250 | 30 | 1 | 50 | 160 | 1080 | 120 | 1070 | 90 | 950 | 40 | 1 | 11 |
| THE PRESENT INVENTION | 35 | W | 806 | 857 | 1250 | 30 | 3 | 40/40/40 | 80 | 1080 | 120 | 1070 | 93 | 940 | 35 | 2 | 14 |
| THE PRESENT INVENTION | 36 | X | 781 | 857 | 1250 | 30 | 3 | 40/40/40 | 80 | 1080 | 120 | 1070 | 93 | 940 | 35 | 2 | 14 |
| THE PRESENT INVENTION | 37 | Y | 784 | 859 | 1250 | 30 | 3 | 40/40/40 | 80 | 1080 | 120 | 1070 | 93 | 940 | 35 | 2 | 14 |
| COMPARATIVE STEEL | 38 | Z | 782 | 857 | 1250 | 30 | 3 | 40/40/40 | 80 | 1080 | 120 | 1070 | 93 | 940 | 35 | 2 | 14 |
| COMPARATIVE STEEL | 39 | AA | 516 | 863 | 1250 | 30 | 3 | 40/40/40 | 80 | 1080 | 120 | 1070 | 93 | 940 | 35 | 2 | 14 |
| THE PRESENT INVENTION | 40 | AB | 581 | 862 | 1250 | 30 | 3 | 40/40/40 | 80 | 1080 | 120 | 1070 | 93 | 940 | 35 | 2 | 14 |
| THE PRESENT INVENTION | 41 | AC | 797 | 856 | 1250 | 30 | 2 | 45/45 | 100 | 1080 | 120 | 1070 | 89 | 930 | 32 | 3 | 10 |
| THE PRESENT INVENTION | 42 | AD | 882 | 855 | 1250 | 30 | 2 | 45/45 | 100 | 1080 | 120 | 1070 | 89 | 930 | 32 | 3 | 10 |
| COMPARATIVE STEEL | 43 | AD | 882 | 855 | 1250 | 30 | 2 | 45/45 | 100 | 1080 | 120 | 1070 | 89 | 930 | 32 | 3 | 10 |
| COMPARATIVE STEEL | 44 | AE | 886 | 855 | 1250 | 30 | 2 | 45/45 | 100 | 1080 | 120 | 1070 | 89 | 930 | 32 | 3 | 10 |
| COMPARATIVE STEEL | 45 | AF | 787 | 857 | 1250 | 30 | 2 | 45/45 | 100 | 1080 | 120 | 1070 | 89 | 930 | 32 | 3 | 10 |
| COMPARATIVE STEEL | 46 | AG | 786 | 871 | 1250 | 30 | 2 | 45/45 | 100 | 1080 | 120 | 1070 | 89 | 930 | 32 | 3 | 10 |
| COMPARATIVE STEEL | 47 | AH | 785 | 862 | 1250 | 30 | 2 | 45/45 | 100 | 1080 | 120 | 1070 | 89 | 930 | 32 | 3 | 10 |
| COMPARATIVE STEEL | 48 | AI | 788 | 857 | 1250 | 30 | 2 | 45/45 | 100 | 1080 | 120 | 1070 | 89 | 930 | 32 | 3 | 10 |
| COMPARATIVE EXAMPLE | 49 | A | 638 | 895 | 1260 | 45 | 2 | 45/45 | 100 | 1090 | 60 | 1080 | 90 | 990 | 40 | 1 | 15 |
| COMPARATIVE EXAMPLE | 50 | B | 723 | 903 | 1260 | 45 | 2 | 45/45 | 100 | 1090 | 60 | 1080 | 90 | 990 | 40 | 1 | 12 |

TABLE 3-continued

| | STEEL NO. | METALLURGICAL FACTOR (1) | (2) | T1 (° C.) | MANUFACTURING CONDITION: HEATING TEMPERATURE CONDITION (3) | (4) | FIRST HOT ROLLING (5) | (6) | (7) | (8) | (9) | SECOND HOT ROLLING (10) | (11) | TF (° C.) | P1 (%) | (12) | (13) |
|---|---|---|---|---|---|---|---|---|---|---|---|---|---|---|---|---|---|
| COMPARATIVE EXAMPLE | 51 | C | 720 | 887 | 1230 | 45 | 3 | 40/40/40 | 80 | 1060 | 60 | 1050 | 93 | 980 | 35 | 2 | 15 |
| COMPARATIVE EXAMPLE | 52 | D | 798 | 896 | 1200 | 60 | 3 | 40/40/40 | 80 | 1030 | 90 | 1020 | 89 | 990 | 32 | 3 | 12 |
| COMPARATIVE EXAMPLE | 53 | E | 779 | 875 | 1200 | 60 | 3 | 40/40/40 | 80 | 1030 | 90 | 1020 | 89 | 970 | 32 | 3 | 12 |
| COMPARATIVE EXAMPLE | 54 | F | 833 | 866 | 1200 | 60 | 3 | 40/40/40 | 80 | 1030 | 90 | 1020 | 89 | 960 | 32 | 3 | 12 |
| COMPARATIVE EXAMPLE | 55 | G | 825 | 851 | 1200 | 60 | 3 | 40/40/40 | 80 | 1030 | 90 | 1020 | 89 | 950 | 32 | 3 | 12 |
| THE PRESENT INVENTION | 56 | H | 813 | 858 | 1200 | 60 | 1 | 50 | 150 | 1030 | 90 | 1020 | 89 | 980 | 35 | 2 | 15 |
| COMPARATIVE EXAMPLE | 57 | H | 813 | 858 | 1200 | 60 | 0 | — | 250 | 1030 | 60 | 1020 | 93 | 980 | 35 | 2 | 15 |
| COMPARATIVE EXAMPLE | 58 | H | 813 | 858 | 1200 | 60 | 1 | 50 | 150 | 1030 | 180 | 1020 | 93 | 980 | 35 | 2 | 15 |
| COMPARATIVE EXAMPLE | 59 | H | 813 | 858 | 1200 | 60 | 1 | 50 | 150 | 1030 | 60 | 1020 | 45 | 980 | 35 | 2 | 15 |
| COMPARATIVE EXAMPLE | 60 | H | 813 | 858 | 1200 | 60 | 1 | 50 | 150 | 1030 | 60 | 1020 | 93 | 800 | 35 | 2 | 15 |

(1) COMPONENT
(2) Ar3 TRANSFORMATION POINT TEMPERATURE (° C.)
(3) HEATING TEMPERATURE (° C.)
(4) HOLDING TIME (MINUTE)
(5) NUMBER OF TIMES OF ROLLING REDUCTION OF 40% OR MORE AT 1000° C. OR MORE
(6) ROLLING-REDUCTION RATIO OF 40% OR MORE AT 1000° C. OR MORE (%)
(7) γ GRAIN SIZE (μm)
(8) ROLLING ENDING TEMPERATURE (° C.)
(9) TIME UNTIL FINISH ROLLING STARTING (SECOND)
(10) ROLLING STARTING TEMPERATURE (° C.)
(11) TOTAL ROLLING-REDUCTION RATIO (%)
(12) NUMBER OF TIMES OF PASS HAVING 30% OR MORE BY ONE PASS
(13) MAXIMUM TEMPERATURE INCREASE BETWEEN PASSES (° C.)

TABLE 4

| | STEEL NO. | METALLURGICAL FACTOR (1) | (2) | T1 (° C.) | MANUFACTURING CONDITION: HEATING TEMPERATURE CONDITION (3) | (4) | FIRST HOT ROLLING (5) | (6) | (7) | (8) | (9) | SECOND HOT ROLLING (10) | (11) | TF (° C.) | P1 (%) | (12) | (13) |
|---|---|---|---|---|---|---|---|---|---|---|---|---|---|---|---|---|---|
| THE PRESENT INVENTION | 61 | H | 813 | 858 | 1200 | 60 | 1 | 50 | 150 | 1030 | 30 | 1020 | 93 | 1050 | 35 | 2 | 15 |
| COMPARATIVE EXAMPLE | 62 | H | 813 | 858 | 1200 | 60 | 1 | 50 | 150 | 1030 | 60 | 1020 | 93 | 980 | — | 0 | 15 |
| THE PRESENT INVENTION | 63 | H | 813 | 858 | 1200 | 60 | 1 | 50 | 150 | 1030 | 60 | 1020 | 93 | 980 | 35 | 2 | 25 |
| THE PRESENT INVENTION | 64 | H | 813 | 858 | 1200 | 60 | 1 | 50 | 150 | 1030 | 60 | 1020 | 93 | 980 | 35 | 2 | 15 |
| COMPARATIVE EXAMPLE | 65 | H | 813 | 858 | 1200 | 60 | 1 | 50 | 150 | 1030 | 60 | 1020 | 93 | 980 | 35 | 2 | 15 |
| COMPARATIVE EXAMPLE | 66 | H | 813 | 858 | 1200 | 60 | 1 | 50 | 150 | 1030 | 60 | 1020 | 93 | 980 | 35 | 2 | 15 |
| COMPARATIVE EXAMPLE | 67 | H | 813 | 858 | 1200 | 60 | 1 | 50 | 150 | 1030 | 60 | 1020 | 93 | 980 | 35 | 2 | 15 |
| COMPARATIVE EXAMPLE | 68 | H | 813 | 858 | 1200 | 60 | 1 | 50 | 150 | 1030 | 60 | 1020 | 93 | 980 | 35 | 2 | 15 |
| COMPARATIVE EXAMPLE | 69 | I | 751 | 876 | 1200 | 60 | 3 | 40/40/40 | 80 | 1030 | 90 | 1020 | 89 | 960 | 32 | 3 | 12 |
| COMPARATIVE EXAMPLE | 70 | J | 699 | 865 | 1200 | 60 | 3 | 40/40/40 | 80 | 1030 | 90 | 1020 | 89 | 950 | 32 | 3 | 12 |
| COMPARATIVE EXAMPLE | 71 | K | 800 | 852 | 1200 | 60 | 3 | 40/40/40 | 80 | 1030 | 90 | 1020 | 89 | 940 | 32 | 3 | 12 |

TABLE 4-continued

| | STEEL NO. | METALLURGICAL FACTOR (1) | (2) | T1 (° C.) | MANUFACTURING CONDITION: HEATING TEMPERATURE CONDITION (3) | (4) | FIRST HOT ROLLING (5) | (6) | (7) | (8) | (9) | SECOND HOT ROLLING (10) | (11) | TF (° C.) | P1 (%) | (12) | (13) |
|---|---|---|---|---|---|---|---|---|---|---|---|---|---|---|---|---|---|
| THE PRESENT INVENTION | 72 | L | 772 | 858 | 1180 | 90 | 3 | 40/40/40 | 80 | 1010 | 90 | 1000 | 89 | 960 | 32 | 3 | 12 |
| THE PRESENT INVENTION | 73 | M | 779 | 856 | 1180 | 90 | 3 | 40/40/40 | 80 | 1010 | 90 | 1000 | 89 | 950 | 32 | 3 | 12 |
| THE PRESENT INVENTION | 74 | N | 662 | 905 | 1180 | 90 | 3 | 40/40/40 | 80 | 1010 | 90 | 1000 | 89 | 940 | 32 | 3 | 12 |
| THE PRESENT INVENTION | 75 | O | 766 | 871 | 1180 | 90 | 3 | 40/40/40 | 80 | 1010 | 90 | 1000 | 89 | 950 | 32 | 3 | 12 |
| THE PRESENT INVENTION | 76 | P | 705 | 866 | 1180 | 90 | 3 | 40/40/40 | 80 | 1010 | 90 | 1000 | 89 | 940 | 32 | 3 | 12 |
| COMPARATIVE STEEL | 77 | Q | 761 | 860 | 1250 | 30 | 1 | 50 | 160 | 1080 | 120 | 1070 | 90 | 950 | 40 | 1 | 11 |
| THE PRESENT INVENTION | 78 | R | 787 | 858 | 1250 | 30 | 1 | 50 | 160 | 1080 | 120 | 1070 | 90 | 950 | 40 | 1 | 11 |
| THE PRESENT INVENTION | 79 | S | 808 | 858 | 1250 | 30 | 1 | 50 | 160 | 1080 | 120 | 1070 | 90 | 950 | 40 | 1 | 11 |
| COMPARATIVE STEEL | 80 | T | 617 | 881 | 1250 | 30 | 1 | 50 | 160 | 1080 | 120 | 1070 | 90 | 950 | 40 | 1 | 11 |
| COMPARATIVE STEEL | 81 | U | 847 | 856 | 1250 | 30 | 1 | 50 | 160 | 1080 | 120 | 1070 | 90 | 950 | 40 | 1 | 11 |
| THE PRESENT INVENTION | 82 | V | 844 | 857 | 1250 | 30 | 1 | 50 | 160 | 1080 | 120 | 1070 | 90 | 950 | 40 | 1 | 11 |
| THE PRESENT INVENTION | 83 | W | 806 | 857 | 1250 | 30 | 3 | 40/40/40 | 80 | 1080 | 120 | 1070 | 93 | 940 | 35 | 2 | 14 |
| THE PRESENT INVENTION | 84 | X | 781 | 857 | 1250 | 30 | 3 | 40/40/40 | 80 | 1080 | 120 | 1070 | 93 | 940 | 35 | 2 | 14 |
| THE PRESENT INVENTION | 85 | Y | 784 | 859 | 1250 | 30 | 3 | 40/40/40 | 80 | 1080 | 120 | 1070 | 93 | 940 | 35 | 2 | 14 |
| COMPARATIVE STEEL | 86 | Z | 782 | 857 | 1250 | 30 | 3 | 40/40/40 | 80 | 1080 | 120 | 1070 | 93 | 940 | 35 | 2 | 14 |
| COMPARATIVE STEEL | 87 | AA | 516 | 863 | 1250 | 30 | 3 | 40/40/40 | 80 | 1080 | 120 | 1070 | 93 | 940 | 35 | 2 | 14 |
| THE PRESENT INVENTION | 88 | AB | 581 | 862 | 1250 | 30 | 3 | 40/40/40 | 80 | 1080 | 120 | 1070 | 93 | 940 | 35 | 2 | 14 |
| THE PRESENT INVENTION | 89 | AC | 797 | 856 | 1250 | 30 | 2 | 45/45 | 100 | 1080 | 120 | 1070 | 89 | 930 | 32 | 3 | 10 |
| THE PRESENT INVENTION | 90 | AD | 882 | 855 | 1250 | 30 | 2 | 45/45 | 100 | 1080 | 120 | 1070 | 89 | 930 | 32 | 3 | 10 |
| COMPARATIVE STEEL | 91 | AD | 882 | 855 | 1250 | 30 | 2 | 45/45 | 100 | 1080 | 120 | 1070 | 89 | 930 | 32 | 3 | 10 |
| COMPARATIVE STEEL | 92 | AD | 882 | 855 | 1250 | 30 | 2 | 45/45 | 100 | 1080 | 120 | 1070 | 89 | 930 | 32 | 3 | 10 |
| COMPARATIVE STEEL | 93 | AE | 886 | 855 | 1250 | 30 | 2 | 45/45 | 100 | 1080 | 120 | 1070 | 89 | 930 | 32 | 3 | 10 |
| COMPARATIVE STEEL | 94 | AF | 787 | 857 | 1250 | 30 | 2 | 45/45 | 100 | 1080 | 120 | 1070 | 89 | 930 | 32 | 3 | 10 |
| COMPARATIVE STEEL | 95 | AG | 786 | 871 | 1250 | 30 | 2 | 45/45 | 100 | 1080 | 120 | 1070 | 89 | 930 | 32 | 3 | 10 |
| COMPARATIVE STEEL | 96 | AH | 785 | 862 | 1250 | 30 | 2 | 45/45 | 100 | 1080 | 120 | 1070 | 89 | 930 | 32 | 3 | 10 |
| COMPARATIVE STEEL | 97 | AI | 788 | 857 | 1250 | 30 | 2 | 45/45 | 100 | 1080 | 120 | 1070 | 89 | 930 | 32 | 3 | 10 |

(1) COMPONENT
(2) Ar3 TRANSFORMATION POINT TEMPERATURE (° C.)
(3) HEATING TEMPERATURE (° C.)
(4) HOLDING TIME (MINUTE)
(5) NUMBER OF TIMES OF ROLLING REDUCTION OF 40% OR MORE AT 1000° C. OR MORE
(6) ROLLING-REDUCTION RATIO OF 40% OR MORE AT 1000° C. OR MORE (%)
(7) γ GRAIN SIZE (μm)
(8) ROLLING ENDING TEMPERATURE (° C.)
(9) TIME UNTIL FINISH ROLLING STARTING (SECOND)
(10) ROLLING STARTING TEMPERATURE (° C.)
(11) TOTAL ROLLING-REDUCTION RATIO (%)
(12) NUMBER OF TIMES OF PASS HAVING 30% OR MORE BY ONE PASS
(13) MAXIMUM TEMPERATURE INCREASE BETWEEN PASSES (° C.)

TABLE 5

| STEEL NO. | THIRD HOT ROLLING TOTAL ROLL-REDUCTION RATIO (%) | COOLING CONDITION t1 (SECOND) | 2.5 × t1 | WAITING TIME UNTIL PRIMARY COOLING STARTING t (SECOND) | t/t1 | PRIMARY COOLING RATE (° C./SECOND) | PRIMARY COOLING TEMPERATURE CHANGE (° C.) | PRIMARY COOLING STOP TEMPERATURE (° C.) | COILING TEMPERATURE (° C.) |
|---|---|---|---|---|---|---|---|---|---|
| 1 | 0 | 0.40 | 1.00 | 0.25 | 0.6 | 60 | 90 | 900 | 650 |
| 2 | 0 | 0.51 | 1.28 | 0.25 | 0.5 | 60 | 90 | 900 | 650 |
| 3 | 0 | 0.62 | 1.55 | 0.25 | 0.4 | 65 | 110 | 870 | 600 |
| 4 | 0 | 0.73 | 1.83 | 0.25 | 0.3 | 60 | 70 | 920 | 600 |
| 5 | 0 | 0.71 | 1.78 | 0.25 | 0.4 | 60 | 70 | 900 | 600 |
| 6 | 0 | 0.72 | 1.80 | 0.25 | 0.3 | 60 | 70 | 890 | 600 |
| 7 | 0 | 0.65 | 1.63 | 0.25 | 0.4 | 60 | 70 | 880 | 600 |
| 8 | 0 | 0.27 | 0.68 | 0.25 | 0.9 | 65 | 110 | 870 | 670 |
| 9 | 0 | 0.27 | 0.68 | 0.25 | 0.9 | 65 | 110 | 870 | 670 |
| 10 | 0 | 0.27 | 0.68 | 0.25 | 0.9 | 65 | 110 | 870 | 670 |
| 11 | 0 | 0.27 | 0.68 | 0.25 | 0.9 | 65 | 110 | 870 | 670 |
| 12 | 0 | 3.40 | 8.50 | 0.25 | 0.1 | 65 | 110 | 690 | 670 |
| 13 | 0 | 0.29 | 0.73 | 0.25 | 0.9 | 65 | 110 | 940 | 670 |
| 14 | 0 | — | — | 0.25 | — | 65 | 110 | 870 | 670 |
| 15 | 0 | 0.27 | 0.68 | 0.25 | 0.9 | 65 | 110 | 870 | 670 |
| 16 | 0 | 0.27 | 0.68 | 0.20 | 0.7 | 65 | 110 | 870 | 670 |
| 17 | 0 | 0.27 | 0.68 | 0.25 | 0.9 | 5 | 110 | 870 | 670 |
| 18 | 0 | 0.27 | 0.68 | 0.25 | 0.9 | 65 | 20 | 960 | 670 |
| 19 | 0 | 0.27 | 0.68 | 0.25 | 0.9 | 65 | 205 | 775 | 670 |
| 20 | 0 | 0.27 | 0.68 | 0.25 | 0.9 | 65 | 110 | 870 | 450 |
| 21 | 0 | 0.89 | 2.23 | 0.60 | 0.7 | 60 | 70 | 890 | 650 |
| 22 | 0 | 0.88 | 2.20 | 0.60 | 0.7 | 60 | 70 | 880 | 650 |
| 23 | 0 | 0.82 | 2.05 | 0.60 | 0.7 | 60 | 70 | 870 | 650 |
| 24 | 0 | 0.61 | 1.53 | 0.60 | 1.0 | 60 | 70 | 890 | 600 |
| 25 | 0 | 0.73 | 1.83 | 0.60 | 0.8 | 60 | 70 | 880 | 600 |
| 26 | 0 | 2.00 | 5.00 | 0.60 | 0.3 | 60 | 70 | 870 | 600 |
| 27 | 0 | 0.99 | 2.48 | 0.60 | 0.6 | 60 | 70 | 880 | 600 |
| 28 | 0 | 1.08 | 2.70 | 0.60 | 0.6 | 60 | 70 | 870 | 600 |
| 29 | 5 | 0.47 | 1.17 | 0.40 | 0.9 | 50 | 80 | 870 | 700 |
| 30 | 5 | 0.44 | 1.11 | 0.40 | 0.9 | 50 | 80 | 870 | 700 |

TABLE 6

| STEEL NO. | THIRD HOT ROLLING TOTAL ROLL-REDUCTION RATIO (%) | COOLING CONDITION t1 (SECOND) | 2.5 × t1 | WAITING TIME UNTIL PRIMARY COOLING STARTING t (SECOND) | t/t1 | PRIMARY COOLING RATE (° C./SECOND) | PRIMARY COOLING TEMPERATURE CHANGE (° C.) | PRIMARY COOLING STOP TEMPERATURE (° C.) | COILING TEMPERATURE (° C.) |
|---|---|---|---|---|---|---|---|---|---|
| 31 | 5 | 0.44 | 1.11 | 0.40 | 0.9 | 50 | 80 | 870 | 700 |
| 32 | 5 | 0.86 | 2.14 | 0.40 | 0.5 | 50 | 80 | 870 | 700 |
| 33 | 5 | 0.42 | 1.05 | 0.40 | 1.0 | 50 | 80 | 870 | 700 |
| 34 | 5 | 0.43 | 1.07 | 0.40 | 0.9 | 50 | 80 | 870 | 790 |
| 35 | 12 | 0.77 | 1.93 | 0.70 | 0.9 | 70 | 130 | 810 | 780 |
| 36 | 12 | 0.77 | 1.92 | 0.70 | 0.9 | 70 | 130 | 810 | 750 |
| 37 | 12 | 0.81 | 2.02 | 0.70 | 0.9 | 70 | 130 | 810 | 750 |
| 38 | 12 | 0.78 | 1.94 | 0.70 | 0.9 | 70 | 130 | 810 | 750 |
| 39 | 12 | 0.89 | 2.24 | 0.70 | 0.8 | 70 | 130 | 810 | 550 |
| 40 | 12 | 0.86 | 2.16 | 0.70 | 0.8 | 70 | 130 | 810 | 550 |
| 41 | 12 | 1.07 | 2.68 | 1.00 | 0.9 | 55 | 85 | 845 | 750 |
| 42 | 25 | 1.05 | 2.63 | 1.00 | 1.0 | 55 | 85 | 845 | 750 |
| 43 | 31 | 1.05 | 2.63 | 1.00 | 1.0 | 55 | 85 | 845 | 750 |
| 44 | 25 | 1.06 | 2.66 | 1.00 | 0.9 | 55 | 85 | 845 | 750 |
| 45 | 25 | 1.09 | 2.73 | 1.00 | 0.9 | 55 | 85 | 845 | 750 |
| 46 | 25 | 1.40 | 3.51 | 1.00 | 0.7 | 55 | 85 | 845 | 750 |
| 47 | 25 | 1.20 | 3.00 | 1.00 | 0.8 | 55 | 85 | 845 | 750 |
| 48 | 25 | 1.09 | 2.74 | 1.00 | 0.9 | 55 | 85 | 845 | 750 |
| 49 | 0 | 0.40 | 1.00 | 1.00 | 2.5 | 60 | 90 | 900 | 650 |
| 50 | 0 | 0.51 | 1.28 | 1.00 | 2.0 | 60 | 90 | 900 | 650 |
| 51 | 0 | 0.62 | 1.55 | 1.00 | 1.6 | 65 | 110 | 870 | 600 |
| 52 | 0 | 0.73 | 1.83 | 1.00 | 1.4 | 60 | 70 | 920 | 600 |
| 53 | 0 | 0.71 | 1.78 | 1.00 | 1.4 | 60 | 70 | 900 | 600 |

TABLE 6-continued

| STEEL NO. | THIRD HOT ROLLING TOTAL ROLL-REDUCTION RATIO (%) | COOLING CONDITION t1 (SECOND) | 2.5 × t1 | WAITING TIME UNTIL PRIMARY COOLING STARTING t (SECOND) | t/t1 | PRIMARY COOLING RATE (° C./SECOND) | PRIMARY COOLING TEMPERATURE CHANGE (° C.) | PRIMARY COOLING STOP TEMPERATURE (° C.) | COILING TEMPERATURE (° C.) |
|---|---|---|---|---|---|---|---|---|---|
| 54 | 0 | 0.72 | 1.80 | 1.00 | 1.4 | 60 | 70 | 890 | 600 |
| 55 | 0 | 0.65 | 1.63 | 1.00 | 1.5 | 60 | 70 | 880 | 600 |
| 56 | 0 | 0.27 | 0.68 | 0.50 | 1.9 | 65 | 110 | 870 | 670 |
| 57 | 0 | 0.27 | 0.68 | 0.50 | 1.9 | 65 | 110 | 870 | 670 |
| 58 | 0 | 0.27 | 0.68 | 0.50 | 1.9 | 65 | 110 | 870 | 670 |
| 59 | 0 | 0.27 | 0.68 | 0.50 | 1.9 | 65 | 110 | 870 | 670 |
| 60 | 0 | 3.40 | 8.50 | 4.00 | 1.2 | 65 | 110 | 690 | 670 |

TABLE 7

| STEEL NO. | THIRD HOT ROLLING TOTAL ROLL-REDUCTION RATIO (%) | COOLING CONDITION t1 (SECOND) | 2.5 × t1 | WAITING TIME UNTIL PRIMARY COOLING STARTING t (SECOND) | t/t1 | PRIMARY COOLING RATE (° C./SECOND) | PRIMARY COOLING TEMPERATURE CHANGE (° C.) | PRIMARY COOLING STOP TEMPERATURE (° C.) | COILING TEMPERATURE (° C.) |
|---|---|---|---|---|---|---|---|---|---|
| 61 | 0 | 0.29 | 0.73 | 0.50 | 1.7 | 65 | 110 | 940 | 670 |
| 62 | 0 | — | — | 0.50 | — | 65 | 110 | 870 | 670 |
| 63 | 0 | 0.27 | 0.68 | 0.50 | 1.9 | 65 | 110 | 870 | 670 |
| 64 | 0 | 0.27 | 0.68 | 0.50 | 1.9 | 65 | 110 | 870 | 670 |
| 65 | 0 | 0.27 | 0.68 | 0.50 | 1.9 | 5 | 110 | 870 | 670 |
| 66 | 0 | 0.27 | 0.68 | 0.50 | 1.9 | 65 | 20 | 960 | 670 |
| 67 | 0 | 0.27 | 0.68 | 0.50 | 1.9 | 65 | 205 | 775 | 670 |
| 68 | 0 | 0.27 | 0.68 | 0.50 | 1.9 | 65 | 110 | 870 | 450 |
| 69 | 0 | 0.89 | 2.23 | 2.00 | 2.2 | 60 | 70 | 890 | 650 |
| 70 | 0 | 0.88 | 2.20 | 2.00 | 2.3 | 60 | 70 | 880 | 650 |
| 71 | 0 | 0.82 | 2.05 | 2.00 | 2.4 | 60 | 70 | 870 | 650 |
| 72 | 0 | 0.61 | 1.53 | 1.00 | 1.6 | 60 | 70 | 890 | 600 |
| 73 | 0 | 0.73 | 1.83 | 1.00 | 1.4 | 60 | 70 | 880 | 600 |
| 74 | 0 | 2.00 | 5.00 | 3.00 | 1.5 | 60 | 70 | 870 | 600 |
| 75 | 0 | 0.99 | 2.48 | 2.00 | 2.0 | 60 | 70 | 880 | 600 |
| 76 | 0 | 1.08 | 2.70 | 2.00 | 1.9 | 60 | 70 | 870 | 600 |
| 77 | 5 | 0.47 | 1.17 | 1.00 | 2.1 | 50 | 80 | 870 | 700 |
| 78 | 5 | 0.44 | 1.11 | 1.00 | 2.3 | 50 | 80 | 870 | 700 |
| 79 | 5 | 0.44 | 1.11 | 1.00 | 2.3 | 50 | 80 | 870 | 700 |
| 80 | 5 | 0.86 | 2.14 | 1.00 | 1.2 | 50 | 80 | 870 | 700 |
| 81 | 5 | 0.42 | 1.05 | 1.00 | 2.4 | 50 | 80 | 870 | 700 |
| 82 | 5 | 0.43 | 1.07 | 1.00 | 2.3 | 50 | 80 | 870 | 790 |
| 83 | 12 | 0.77 | 1.93 | 1.00 | 1.3 | 70 | 130 | 810 | 780 |
| 84 | 12 | 0.77 | 1.92 | 1.00 | 1.3 | 70 | 130 | 810 | 750 |
| 85 | 12 | 0.81 | 2.02 | 1.00 | 1.2 | 70 | 130 | 810 | 750 |
| 86 | 12 | 0.78 | 1.94 | 1.00 | 1.3 | 70 | 130 | 810 | 750 |
| 87 | 12 | 0.89 | 2.24 | 1.00 | 1.1 | 70 | 130 | 810 | 550 |
| 88 | 12 | 0.86 | 2.16 | 1.00 | 1.2 | 70 | 130 | 810 | 550 |
| 89 | 12 | 1.07 | 2.68 | 2.00 | 1.9 | 55 | 85 | 845 | 750 |
| 90 | 25 | 1.05 | 2.63 | 2.00 | 1.9 | 55 | 85 | 845 | 750 |
| 91 | 31 | 1.05 | 2.63 | 2.00 | 1.9 | 55 | 85 | 845 | 750 |
| 92 | 25 | 1.05 | 2.63 | 4.00 | 3.8 | 55 | 85 | 845 | 750 |
| 93 | 25 | 1.06 | 2.66 | 2.00 | 1.9 | 55 | 85 | 845 | 750 |
| 94 | 25 | 1.09 | 2.73 | 2.00 | 1.8 | 55 | 85 | 845 | 750 |
| 95 | 25 | 1.40 | 3.51 | 2.00 | 1.4 | 55 | 85 | 845 | 750 |
| 96 | 25 | 1.20 | 3.00 | 2.00 | 1.7 | 55 | 85 | 845 | 750 |
| 97 | 25 | 1.09 | 2.74 | 2.00 | 1.8 | 55 | 85 | 845 | 750 |

TABLE 8

| STEEL | MICROSTRUCTURE | | | | | | | MECHANICAL PROPERTIES BEFORE NITRIDING | | | | | TOUGHNESS | |
|---|---|---|---|---|---|---|---|---|---|---|---|---|---|---|
| | | | | | | | | TENSILE TEST | | | | HOLE EXPANSIBILITY | TOUGHNESS | AFTER NITRIDING |
| | | | | | | | | YP | TS | El | ISOTROPY | λ | vTrs | vTrs |
| NO. | (1) | (2) | (3) | (4) | (5) | (6) | (7) | (MPa) | (MPa) | (%) | 1/\|Δr\| | (%) | (° C.) | (° C.) |
| 1 | 5.9 | 1.0 | 5.5 | 3.7 | 4.5 | 500 | 21 | 774 | 941 | 15.6 | 3.5 | 70 | −108 | −18 |
| 2 | 6.0 | 1.0 | 6.0 | 3.7 | 4.5 | 500 | 21 | 770 | 895 | 16.8 | 3.5 | 75 | −93 | −19 |
| 3 | 5.7 | 0.8 | 6.0 | 3.8 | 4.5 | 475 | 21 | 721 | 810 | 18.5 | 3.5 | 76 | −93 | −18 |
| 4 | 3.1 | 0.8 | 5.0 | 3.7 | 4.5 | 500 | 24 | 716 | 794 | 19.2 | 3.5 | 77 | −125 | −10 |
| 5 | 3.7 | 0.8 | 7.0 | 4.0 | 4.7 | 450 | 23 | 733 | 814 | 18.7 | 3.5 | 74 | −68 | −12 |
| 6 | 3.6 | 0.8 | 6.0 | 4.0 | 4.7 | 450 | 23 | 477 | 603 | 27.6 | 3.5 | 79 | −93 | −13 |
| 7 | 7.6 | 0.8 | 7.5 | 4.0 | 4.7 | 300 | 19 | 360 | 480 | 33.6 | 3.5 | 90 | −58 | −20 |
| 8 | 15.3 | 1.1 | 6.0 | 3.7 | 4.4 | 450 | 12 | 388 | 511 | 30.0 | 3.5 | 72 | −93 | −48 |
| 9 | 13.6 | 1.1 | 10.5 | 4.0 | 4.8 | 450 | 13 | 365 | 488 | 32.0 | 3.5 | 71 | −11 | −5 |
| 10 | 14.1 | 1.1 | 10.5 | 4.0 | 4.8 | 450 | 13 | 355 | 470 | 29.4 | 3.5 | 74 | −15 | −5 |
| 11 | 15.3 | 1.1 | 11.0 | 5.2 | 5.4 | 450 | 12 | 396 | 520 | 28.5 | 3.0 | 60 | −19 | −10 |
| 12 | 15.2 | 1.1 | 3.0 | 7.1 | 6.2 | 450 | 12 | 440 | 536 | 22.0 | 2.9 | 69 | −124 | −67 |
| 13 | 12.3 | 1.1 | 7.0 | 3.7 | 4.5 | 450 | 15 | 352 | 466 | 29.3 | 3.5 | 72 | −45 | −42 |
| 14 | 15.0 | 1.1 | 11.0 | 7.3 | 6.3 | 450 | 12 | 399 | 522 | 30.1 | 2.8 | 66 | −10 | 0 |
| 15 | 12.0 | 1.1 | 7.0 | 3.7 | 4.4 | 450 | 15 | 381 | 505 | 31.8 | 3.5 | 74 | −50 | −45 |
| 16 | 11.4 | 1.1 | 5.5 | 3.6 | 4.3 | 450 | 16 | 360 | 481 | 32.0 | 3.6 | 78 | −100 | −60 |
| 17 | 13.0 | 1.1 | 10.5 | 3.8 | 4.5 | 400 | 14 | 357 | 477 | 30.8 | 3.5 | 75 | −11 | 0 |
| 18 | 12.0 | 1.1 | 10.5 | 3.8 | 4.5 | 400 | 15 | 371 | 495 | 28.9 | 3.5 | 76 | −15 | −5 |
| 19 | 0.0 | — | 4.5 | 7.4 | 6.3 | 400 | 30 | 403 | 530 | 30.5 | 2.8 | 64 | −126 | −19 |
| 20 | 0.5 | — | 6.5 | 3.9 | 4.6 | 350 | 27 | 381 | 500 | 26.8 | 3.5 | 72 | −80 | −18 |
| 21 | 1.9 | 1.0 | 6.5 | 4.0 | 4.7 | 450 | 25 | 434 | 571 | 33.7 | 3.5 | 71 | −80 | −15 |
| 22 | 0.3 | — | 9.0 | 4.0 | 4.7 | 350 | 27 | 294 | 431 | 36.5 | 3.5 | 82 | −31 | −18 |
| 23 | 29.6 | 1.0 | 7.0 | 4.0 | 4.8 | 300 | 7 | 360 | 505 | 29.2 | 3.5 | 70 | −58 | −25 |
| 24 | 7.7 | 0.8 | 4.5 | 3.6 | 4.4 | 400 | 19 | 380 | 503 | 29.1 | 3.5 | 80 | −128 | −80 |
| 25 | 8.5 | 0.8 | 5.5 | 3.5 | 4.3 | 400 | 18 | 372 | 496 | 30.5 | 3.5 | 81 | −108 | −58 |
| 26 | 6.9 | 0.8 | 5.0 | 3.5 | 4.3 | 400 | 20 | 385 | 530 | 28.8 | 3.5 | 75 | −125 | −68 |
| 27 | 7.7 | 0.8 | 6.0 | 3.5 | 4.3 | 400 | 19 | 388 | 509 | 30.0 | 3.5 | 78 | −93 | −48 |
| 28 | 7.4 | 0.8 | 5.5 | 3.5 | 4.3 | 400 | 20 | 394 | 522 | 29.0 | 3.5 | 73 | −108 | −58 |
| 29 | 21.0 | 1.6 | 4.0 | 4.0 | 4.8 | 450 | 10 | 432 | 568 | 26.4 | 3.5 | 60 | −131 | −55 |
| 30 | 10.4 | 1.6 | 5.5 | 3.9 | 4.6 | 450 | 15 | 390 | 513 | 29.2 | 3.5 | 78 | −108 | −50 |

(1) PEARLITE FRACTION (%)(2) LAMELLAR SPACING (μm)(3) AVERAGE CRYSTAL GRAIN SIZE (μm)(4) AVERAGE POLE DENSITY OF ORIENTATION GROUP OF {100}<011> TO {223}<110>
(5) POLE DENSITY OF CRYSTAL ORIENTATION OF {332}<113>
(6) AVERAGE HARDNESS IN 0 TO 5 μm OF COMPOUND LAYER AFTER GAS NITROCARBURIZING (Hv(0.005 kgf))
(7) COMPOUND LAYER DEPTH AFTER GAS NITROCARBURIZING (μm)

TABLE 9

| STEEL | MICROSTRUCTURE | | | | | | | MECHANICAL PROPERTIES BEFORE NITRIDING | | | | | TOUGHNESS | |
|---|---|---|---|---|---|---|---|---|---|---|---|---|---|---|
| | | | | | | | | TOUGHNESS | | | | HOLE EXPANSIBILITY | TOUGHNESS | AFTER NITRIDING |
| | | | | | | | | YP | TS | El | ISOTROPY | λ | vTrs | vTrs |
| NO. | (1) | (2) | (3) | (4) | (5) | (6) | (7) | (MPa) | (MPa) | (%) | 1/\|Δr\| | (%) | (° C.) | (° C.) |
| 31 | 6.1 | 1.6 | 6.0 | 3.8 | 4.5 | 400 | 18 | 373 | 491 | 30.5 | 3.5 | 81 | −93 | −50 |
| 32 | 5.8 | 1.6 | 7.0 | 4.0 | 4.8 | 400 | 22 | 321 | 422 | 35.5 | 3.5 | 95 | −58 | −15 |
| 33 | 6.0 | 1.6 | 7.0 | 3.8 | 4.6 | 400 | 24 | 417 | 549 | 27.3 | 3.5 | 73 | −68 | −10 |
| 34 | 6.4 | 2.0 | 7.0 | 3.7 | 4.5 | 400 | 20 | 411 | 541 | 27.7 | 3.5 | 74 | −68 | −41 |
| 35 | 12.0 | 2.0 | 6.5 | 3.7 | 4.4 | 375 | 17 | 423 | 556 | 27.0 | 3.5 | 72 | −80 | −67 |
| 36 | 11.0 | 1.8 | 6.0 | 3.8 | 4.6 | 375 | 16 | 385 | 506 | 29.6 | 3.5 | 74 | −93 | −78 |
| 37 | 6.1 | 1.8 | 5.5 | 3.9 | 4.7 | 375 | 19 | 373 | 491 | 30.5 | 3.6 | 81 | −108 | −40 |
| 38 | 5.4 | 1.8 | 5.5 | 3.9 | 4.7 | 400 | 22 | 333 | 438 | 34.2 | 3.5 | 91 | −108 | −18 |
| 39 | 2.0 | 0.5 | 4.0 | 3.6 | 4.4 | 425 | 26 | 528 | 695 | 21.6 | 3.7 | 72 | −127 | −19 |
| 40 | 6.1 | 0.5 | 4.5 | 3.7 | 4.5 | 425 | 20 | 487 | 641 | 23.4 | 3.5 | 71 | −122 | −50 |
| 41 | 13.0 | 1.8 | 6.0 | 3.6 | 4.4 | 400 | 17 | 378 | 498 | 30.1 | 3.6 | 70 | −93 | −40 |
| 42 | 6.3 | 1.8 | 6.5 | 3.9 | 4.7 | 350 | 18 | 335 | 441 | 34.0 | 3.5 | 91 | −80 | −40 |
| 43 | 6.2 | 1.8 | 4.5 | 7.0 | 6.2 | 350 | 18 | 353 | 464 | 32.0 | 2.9 | 68 | −136 | −84 |
| 44 | 5.7 | 1.8 | 7.0 | 3.9 | 4.7 | 350 | 24 | 324 | 426 | 35.2 | 3.5 | 94 | −68 | −10 |
| 45 | 7.0 | 1.8 | 7.0 | 3.8 | 4.6 | 350 | 17 | 377 | 496 | 24.0 | 3.5 | 55 | −18 | 5 |
| 45 | 7.0 | 1.8 | 7.0 | 3.8 | 4.6 | 350 | 17 | 377 | 496 | 24.0 | 3.5 | 55 | −18 | 5 |
| 46 | 7.1 | 1.8 | 7.0 | 3.8 | 4.6 | 350 | 17 | 371 | 488 | 21.0 | 3.5 | 42 | −16 | 10 |
| 47 | 4.0 | 1.8 | 7.0 | 4.0 | 4.7 | 450 | 27 | 389 | 512 | 29.3 | 3.5 | 78 | −68 | −5 |
| 48 | 14.0 | 1.8 | 11.0 | 3.5 | 4.3 | 300 | 8 | 388 | 510 | 29.4 | 3.5 | 71 | −5 | 0 |
| 49 | 5.8 | 1.0 | 7.5 | 1.9 | 2.7 | 500 | 21 | 663 | 872 | 17.2 | 7.5 | 79 | −58 | −18 |

TABLE 9-continued

| STEEL | MICROSTRUCTURE | | | | | | | MECHANICAL PROPERTIES BEFORE NITRIDING | | | | | TOUGHNESS |
|---|---|---|---|---|---|---|---|---|---|---|---|---|---|
| | | | | | | | | TOUGHNESS | | | | HOLE EXPANSIBILITY | TOUGHNESS AFTER NITRIDING |
| | | | | | | | | YP | TS | El | ISOTROPY | λ | vTrs |
| NO. | (1) | (2) | (3) | (4) | (5) | (6) | (7) | (MPa) | (MPa) | (%) | 1/\|Δr\| | (%) | (° C.) | (° C.) |
| 50 | 5.9 | 1.0 | 8.0 | 1.9 | 2.7 | 500 | 21 | 630 | 829 | 18.1 | 7.5 | 80 | −48 | −19 |
| 51 | 5.6 | 0.8 | 8.0 | 2.0 | 2.9 | 475 | 21 | 571 | 751 | 20.0 | 6.5 | 81 | −48 | −18 |
| 52 | 3.0 | 0.8 | 7.0 | 1.9 | 2.7 | 500 | 24 | 560 | 736 | 20.4 | 7.5 | 82 | −68 | −10 |
| 53 | 3.6 | 0.8 | 9.0 | 2.0 | 3.0 | 450 | 23 | 574 | 755 | 19.9 | 6.5 | 82 | −31 | −12 |
| 54 | 3.5 | 0.8 | 8.0 | 2.0 | 3.0 | 450 | 23 | 426 | 561 | 26.7 | 6.5 | 71 | −48 | −13 |
| 55 | 7.5 | 0.8 | 9.5 | 2.0 | 3.0 | 300 | 19 | 340 | 448 | 33.5 | 6.5 | 89 | −24 | −20 |
| 56 | 15.2 | 1.1 | 8.0 | 2.0 | 2.9 | 450 | 12 | 362 | 476 | 31.5 | 6.5 | 84 | −48 | −48 |
| 57 | 13.5 | 1.1 | 12.5 | 2.0 | 3.0 | 450 | 13 | 346 | 455 | 33.0 | 6.5 | 76 | 10 | 15 |
| 58 | 14.0 | 1.1 | 12.5 | 2.1 | 3.2 | 450 | 13 | 335 | 441 | 34.0 | 5.9 | 79 | 10 | 15 |
| 59 | 15.2 | 1.1 | 12.0 | 4.2 | 4.9 | 450 | 12 | 368 | 484 | 31.0 | 3.2 | 60 | 6 | 10 |
| 60 | 15.1 | 1.1 | 5.0 | 5.3 | 5.4 | 450 | 12 | 386 | 499 | 26.0 | 3.0 | 63 | −125 | −67 |

(1) PEARLITE FRACTION (%)(2) LAMELLAR SPACING (μm)(3) AVERAGE CRYSTAL GRAIN SIZE (μm)(4) AVERAGE POLE DENSITY OF ORIENTATION GROUP OF {100}<011> TO {223}<110>
(5) POLE DENSITY OF CRYSTAL ORIENTATION OF {332}<113>
(6) AVERAGE HARDNESS IN 0 TO 5 μm OF COMPOUND LAYER AFTER GAS NITROCARBURIZING (Hv(0.005 kgf))
(7) COMPOUND LAYER DEPTH AFTER GAS NITROCARBURIZING (μm)

TABLE 10

| STEEL | MICROSTRUCTURE | | | | | | | MECHANICAL PROPERTIES BEFORE NITRIDING | | | | | TOUGHNESS |
|---|---|---|---|---|---|---|---|---|---|---|---|---|---|
| | | | | | | | | TOUGHNESS | | | | HOLE EXPANSIBILITY | TOUGHNESS AFTER NITRIDING |
| | | | | | | | | YP | TS | El | ISOTROPY | λ | vTrs |
| NO. | (1) | (2) | (3) | (4) | (5) | (6) | (7) | (MPa) | (MPa) | (%) | 1/\|Δr\| | (%) | (° C.) | (° C.) |
| 61 | 12.2 | 1.1 | 10.0 | 1.9 | 2.7 | 450 | 15 | 334 | 440 | 34.1 | 7.5 | 91 | −25 | −20 |
| 62 | 14.9 | 1.1 | 13.0 | 5.5 | 5.5 | 450 | 12 | 370 | 486 | 30.8 | 3.0 | 64 | 15 | 20 |
| 63 | 11.9 | 1.1 | 10.0 | 1.9 | 2.7 | 450 | 15 | 358 | 471 | 31.9 | 7.5 | 85 | −26 | −20 |
| 64 | 11.3 | 1.1 | 7.5 | 2.0 | 3.0 | 450 | 16 | 341 | 449 | 33.4 | 6.3 | 89 | −40 | −30 |
| 65 | 12.9 | 1.1 | 12.5 | 2.0 | 2.9 | 400 | 14 | 338 | 445 | 33.7 | 6.5 | 90 | 10 | 15 |
| 66 | 11.9 | 1.1 | 12.5 | 2.0 | 2.9 | 400 | 15 | 351 | 461 | 32.5 | 6.5 | 87 | 10 | 13 |
| 67 | 0.0 | — | 6.5 | 5.6 | 5.6 | 400 | 30 | 375 | 494 | 30.4 | 3.0 | 66 | −80 | −19 |
| 68 | 0.4 | — | 8.5 | 2.0 | 3.0 | 350 | 27 | 354 | 466 | 32.2 | 6.0 | 86 | −39 | −18 |
| 69 | 1.8 | 1.0 | 8.5 | 2.0 | 3.0 | 450 | 25 | 404 | 531 | 28.2 | 6.1 | 75 | −39 | −15 |
| 70 | 0.2 | — | 11.0 | 2.0 | 3.0 | 350 | 27 | 306 | 403 | 37.3 | 6.1 | 99 | −5 | 0 |
| 71 | 29.5 | 1.0 | 9.5 | 1.9 | 3.0 | 300 | 7 | 358 | 471 | 31.9 | 6.0 | 85 | −24 | −20 |
| 72 | 7.6 | 0.8 | 6.5 | 2.0 | 3.0 | 400 | 19 | 356 | 469 | 32.0 | 6.0 | 85 | −80 | −50 |
| 73 | 8.4 | 0.8 | 7.5 | 2.0 | 3.0 | 400 | 18 | 351 | 462 | 32.4 | 6.1 | 87 | −58 | −38 |
| 74 | 6.8 | 0.8 | 7.0 | 2.0 | 3.0 | 400 | 20 | 375 | 494 | 30.4 | 6.0 | 81 | −68 | −48 |
| 75 | 7.6 | 0.8 | 8.0 | 2.0 | 3.0 | 400 | 19 | 360 | 474 | 31.6 | 6.2 | 84 | −48 | −38 |
| 76 | 7.3 | 0.8 | 7.5 | 2.0 | 3.0 | 400 | 20 | 370 | 486 | 30.8 | 6.0 | 82 | −58 | −48 |
| 77 | 20.9 | 1.6 | 6.0 | 2.2 | 3.4 | 450 | 10 | 402 | 529 | 28.4 | 5.4 | 48 | −53 | −20 |
| 78 | 10.3 | 1.6 | 7.5 | 2.0 | 3.0 | 450 | 15 | 363 | 478 | 31.4 | 6.0 | 84 | −58 | −48 |
| 79 | 6.1 | 1.6 | 8.0 | 2.0 | 2.9 | 400 | 18 | 348 | 458 | 32.8 | 6.5 | 87 | −48 | −30 |
| 80 | 5.7 | 1.6 | 9.5 | 1.9 | 3.0 | 400 | 22 | 300 | 394 | 38.0 | 6.3 | 101 | −24 | −10 |
| 81 | 5.9 | 1.6 | 9.0 | 2.0 | 2.9 | 400 | 24 | 388 | 511 | 29.3 | 6.5 | 78 | −31 | −5 |
| 82 | 6.3 | 2.0 | 9.0 | 1.9 | 2.7 | 400 | 20 | 383 | 504 | 29.8 | 7.5 | 79 | −31 | −25 |
| 83 | 11.9 | 2.0 | 8.5 | 1.9 | 2.7 | 375 | 17 | 393 | 518 | 29.0 | 7.5 | 77 | −39 | −30 |
| 84 | 10.9 | 1.8 | 8.0 | 2.0 | 2.9 | 375 | 16 | 358 | 472 | 31.8 | 6.5 | 85 | −48 | −30 |
| 85 | 6.1 | 1.8 | 7.5 | 2.0 | 3.0 | 375 | 19 | 348 | 458 | 32.8 | 6.1 | 87 | −58 | −40 |
| 86 | 5.3 | 1.8 | 7.5 | 2.0 | 3.0 | 400 | 22 | 311 | 409 | 36.7 | 6.0 | 98 | −58 | −18 |
| 87 | 1.9 | 0.5 | 6.0 | 1.8 | 2.6 | 425 | 26 | 491 | 645 | 23.2 | 9.2 | 84 | −93 | −19 |
| 88 | 6.1 | 0.5 | 6.5 | 1.9 | 2.7 | 425 | 20 | 453 | 596 | 25.2 | 7.5 | 70 | −80 | −50 |
| 89 | 12.9 | 1.8 | 8.0 | 1.8 | 2.6 | 400 | 17 | 353 | 464 | 32.3 | 9.2 | 86 | −48 | −40 |
| 90 | 6.2 | 1.8 | 8.5 | 2.0 | 3.0 | 350 | 18 | 344 | 440 | 34.0 | 6.1 | 91 | −39 | −35 |
| 91 | 6.2 | 1.8 | 6.0 | 6.0 | 5.7 | 350 | 18 | 348 | 457 | 33.0 | 2.9 | 68 | −90 | −60 |
| 92 | 6.2 | 1.8 | 14.0 | 1.4 | 2.1 | 350 | 18 | 650 | 441 | 32.0 | 15.0 | 91 | −10 | 15 |
| 93 | 5.6 | 1.8 | 9.0 | 2.0 | 3.0 | 350 | 24 | 334 | 440 | 34.1 | 6.0 | 91 | −31 | −10 |
| 94 | 6.9 | 1.8 | 9.0 | 2.0 | 2.9 | 350 | 17 | 351 | 462 | 24.0 | 6.5 | 48 | −18 | −5 |
| 95 | 7.0 | 1.8 | 9.0 | 2.0 | 2.9 | 350 | 17 | 346 | 455 | 26.0 | 6.5 | 61 | −16 | −7 |

TABLE 10-continued

| STEEL | MICROSTRUCTURE | | | | | | | MECHANICAL PROPERTIES BEFORE NITRIDING | | | | | TOUGHNESS AFTER NITRIDING |
|---|---|---|---|---|---|---|---|---|---|---|---|---|---|
| | | | | | | | | TOUGHNESS | | | | HOLE EXPANSIBILITY | TOUGHNESS | |
| | | | | | | | | YP | TS | El | ISOTROPY | λ | vTrs | vTrs |
| NO. | (1) | (2) | (3) | (4) | (5) | (6) | (7) | (MPa) | (MPa) | (%) | 1/\|Δr\| | (%) | (° C.) | (° C.) |
| 96 | 4.2 | 1.8 | 9.0 | 2.0 | 3.0 | 450 | 25 | 363 | 477 | 31.4 | 6.1 | 84 | −31 | −5 |
| 97 | 13.9 | 1.8 | 13.0 | 1.7 | 2.4 | 300 | 8 | 361 | 475 | 31.6 | 12.5 | 84 | 15 | 20 |

(1) PEARLITE FRACTION (%)(2) LAMELLAR SPACING (μm)(3) AVERAGE CRYSTAL GRAIN SIZE (μm)(4) AVERAGE POLE DENSITY OF ORIENTATION GROUP OF {100}<011> TO {223}<110>
(5) POLE DENSITY OF CRYSTAL ORIENTATION OF {332}<113>
(6) AVERAGE HARDNESS IN 0 TO 5 μm OF COMPOUND LAYER AFTER GAS NITROCARBURIZING (Hv(0.005 kgf))
(7) COMPOUND LAYER DEPTH AFTER GAS NITROCARBURIZING (μm)

INDUSTRIAL APPLICABILITY

According to the present invention, a hot-rolled steel sheet for gas nitrocarburizing, which includes improved isotropic workability capable of being applied to a member which requires ductility and strict uniformity, of a sheet thickness, circularity, and impact resistance after processing, is obtained. The steel sheet, which is manufactured by the present invention, can be used in a vehicle member such as an inner sheet member, a structural member, a suspension arm, or a transmission which requires ductility and strict uniformity of a sheet thickness, circularity, and impact resistance after processing, and can be used in every use such as shipbuilding, buildings, bridges, offshore structures, pressure vessels, line pipes, and machine parts. Therefore, the present invention has high industrial value.

The invention claimed is:

1. A hot-rolled steel sheet for gas nitrocarburizing comprising, by mass %,

C content [C]: C of more than 0.07% and equal to or less than 0.2%,

Si content [Si]: Si of 0.001% or more and 2.5% or less,

Mn content [Mn]: Mn of 0.01% or more and 4% or less, and

Al content [Al]: Al of 0.001% or more and 2% or less,

P content [P] limited to 0.15% or less,

S content [S] limited to 0.03% or less, and

N content [N] limited to 0.01% or less,

Ti content [Ti] which satisfies the following Equation 1, and the balance comprising Fe and unavoidable impurities, wherein an average pole density of an orientation group of {100}<011> to {223}<110>, which is represented by an arithmetic average of a pole density of each orientation of {100}<011>, {116}<110>, {114}<110>, {112}<110>, and {223}<110> is 1.0 or more and 4.0 or less, and a pole density of a crystal orientation of {332}<113> is 1.0 or more and 3.0 or less, in a center portion of a sheet thickness which is a range of the sheet thickness of ⅝ to ⅜ from a surface of the steel sheet, wherein an average grain size in a center in the sheet thickness is 10 μm or less, and wherein a microstructure includes, by a structural fraction, pearlite of more than 6% and ferrite in the balance, $$0.005+[N]\times 48/14+[S]\times 48/32 \leq Ti \leq 0.015+[N]\times 48/14+[S]\times 48/32 \quad (1).$$

2. The hot-rolled steel sheet for gas nitrocarburizing according to claim 1, wherein the average pole density of the orientation group of {100}<011> to {223}<110> is 2.0 or less.

3. The hot-rolled steel sheet for gas nitrocarburizing according to claim 1, wherein the average grain size is 7 μm or less.

4. The hot-rolled steel sheet for gas nitrocarburizing according to claim 1, further comprising any one or two or more of, by mass %, Nb content [Nb]: Nb of 0.005% or more and 0.06% or less, Cu content [Cu]: Cu of 0.02% or more and 1.2% or less, Ni content [Ni]: Ni of 0.01% or more and 0.6% or less, Mo content [Mo]: Mo of 0.01% or more and 1% or less, V content [V]: V of 0.01% or more and 0.2% or less, Cr content [Cr]: Cr of 0.01% or more and 2% or less, Mg content [Mg]: Mg of 0.0005% or more and 0.01% or less, Ca content [Ca]: Ca of 0.0005% or more and 0.01% or less, REM content [REM]: REM of 0.0005% or more and 0.1% or less, and B content [B]: B of 0.0002% or more and 0.002% or less.

5. The hot-rolled steel sheet for gas nitrocarburizing according to claim 2, further comprising any one or two or more of, by mass %, Nb content [Nb]: Nb of 0.005% or more and 0.06% or less, Cu content [Cu]: Cu of 0.02% or more and 1.2% or less, Ni content [Ni]: Ni of 0.01% or more and 0.6% or less, Mo content [Mo]: Mo of 0.01% or more and 1% or less, V content [V]: V of 0.01% or more and 0.2% or less, Cr content [Cr]: Cr of 0.01% or more and 2% or less, Mg content [Mg]: Mg of 0.0005% or more and 0.01% or less, Ca content [Ca]: Ca of 0.0005% or more and 0.01% or less, REM content [REM]: REM of 0.0005% or more and 0.1% or less, and B content [B]: B of 0.0002% or more and 0.002% or less.

6. The hot-rolled steel sheet for gas nitrocarburizing according to claim 3, further comprising any one or two or more of, by mass %, Nb content [Nb]: Nb of 0.005% or more and 0.06% or less, Cu content [Cu]: Cu of 0.02% or more and 1.2% or less, Ni content [Ni]: Ni of 0.01% or more and 0.6% or less, Mo content [Mo]: Mo of 0.01% or more and 1% or less, V content [V]: V of 0.01% or more and 0.2% or less, Cr content [Cr]: Cr of 0.01% or more and 2% or less, Mg content [Mg]: Mg of 0.0005% or more and 0.01% or less, Ca content [Ca]: Ca of 0.0005% or more and 0.01% or less, REM content [REM]: REM of 0.0005% or more and 0.1% or less, and B content [B]: B of 0.0002% or more and 0.002% or less.

* * * * *